US008116483B2

(12) United States Patent
Mitsuhashi

(10) Patent No.: US 8,116,483 B2
(45) Date of Patent: Feb. 14, 2012

(54) SPEAKER DEVICE WITH THE PHASE CHANGING DEVICE FOR VARYING THE PHASE OF THE AUDIO SIGNAL

(75) Inventor: Takashi Mitsuhashi, Saitama (JP)

(73) Assignee: Pioneer Corporation, Tokyo (JP)

( * ) Notice: Subject to any disclaimer, the term of this patent is extended or adjusted under 35 U.S.C. 154(b) by 740 days.

(21) Appl. No.: 12/294,676

(22) PCT Filed: Mar. 23, 2007

(86) PCT No.: PCT/JP2007/056052

§ 371 (c)(1),
(2), (4) Date: Dec. 4, 2008

(87) PCT Pub. No.: WO2007/116658

PCT Pub. Date: Oct. 18, 2007

(65) Prior Publication Data

US 2010/0220871 A1 Sep. 2, 2010

(30) Foreign Application Priority Data

Mar. 28, 2006 (JP) ..... 2006-089269

(51) Int. Cl.
*H04R 3/00* (2006.01)
*H04R 1/40* (2006.01)

(52) U.S. Cl. ..... 381/97; 381/102; 381/106; 455/72

(58) Field of Classification Search ..... 381/97, 381/102, 106
See application file for complete search history.

(56) References Cited

U.S. PATENT DOCUMENTS

2006/0215853 A1 * 9/2006 Hiruma et al. ..... 381/97

FOREIGN PATENT DOCUMENTS

| | | |
|---|---|---|
| JP | 04-132499 | 5/1992 |
| JP | 2528178 | 6/1996 |
| JP | 2574454 | 10/1996 |
| JP | 2675388 | 7/1997 |
| JP | 2846363 | 10/1998 |
| JP | 3205625 | 6/2001 |
| JP | 3422281 | 4/2003 |
| JP | 3422282 | 4/2003 |
| JP | 3422296 | 4/2003 |
| JP | 3473517 | 9/2003 |
| KP | 2574454 | 10/1996 |

* cited by examiner

*Primary Examiner* — Thanh V Pham
(74) *Attorney, Agent, or Firm* — Young & Thompson

(57) ABSTRACT

A speaker device comprises a first speaker (SP1) for reproducing an audio signal and a second speaker (SP2) adapted for reproducing an audio signal and spaced from the first speaker horizontally by a predetermined distance. At least one of the first and second speakers phase has varying means (APF1, APF2, . . . ) for varying the phase of the audio signal by a predetermined quantity of phase according to (i) the frequency of the audio signal and (ii) the predetermined distance.

13 Claims, 17 Drawing Sheets

[FIG. 1]
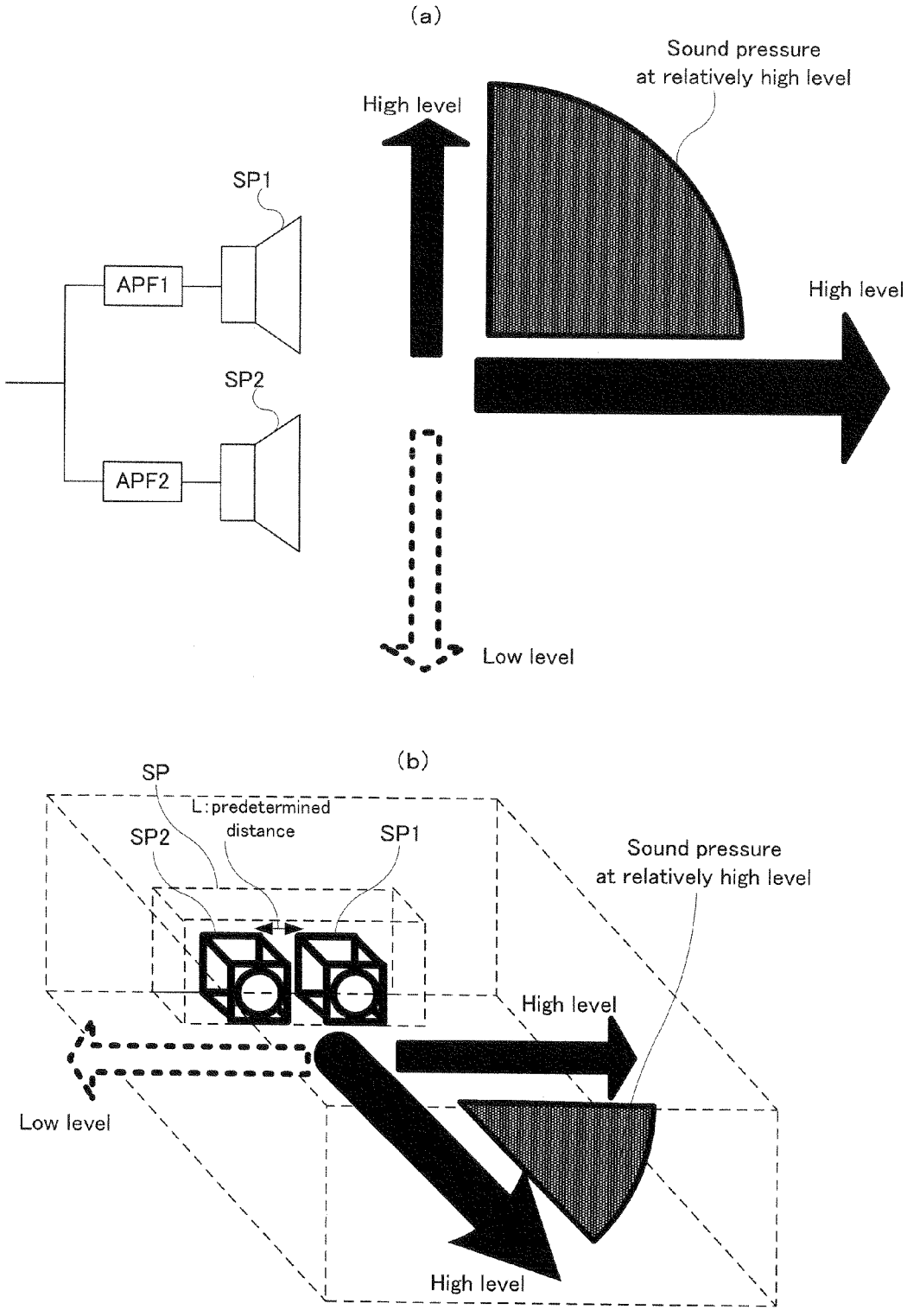

[FIG. 2]
(a)
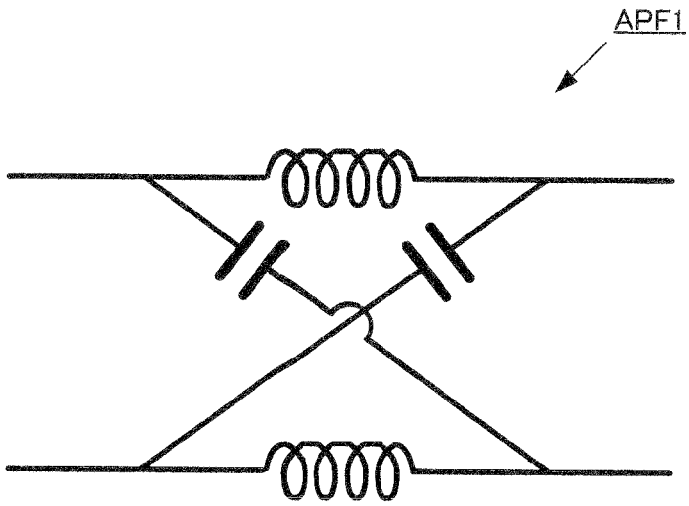
(b)
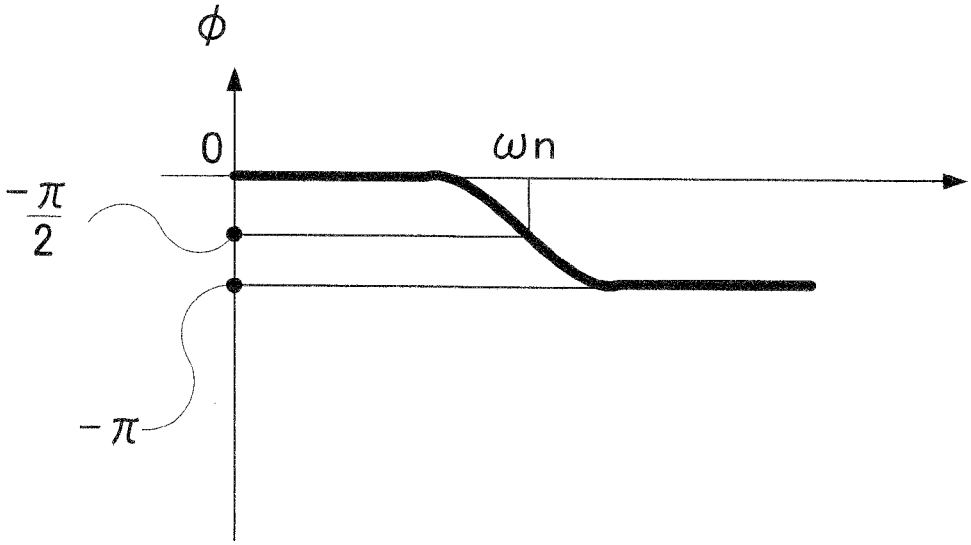

[FIG. 3]
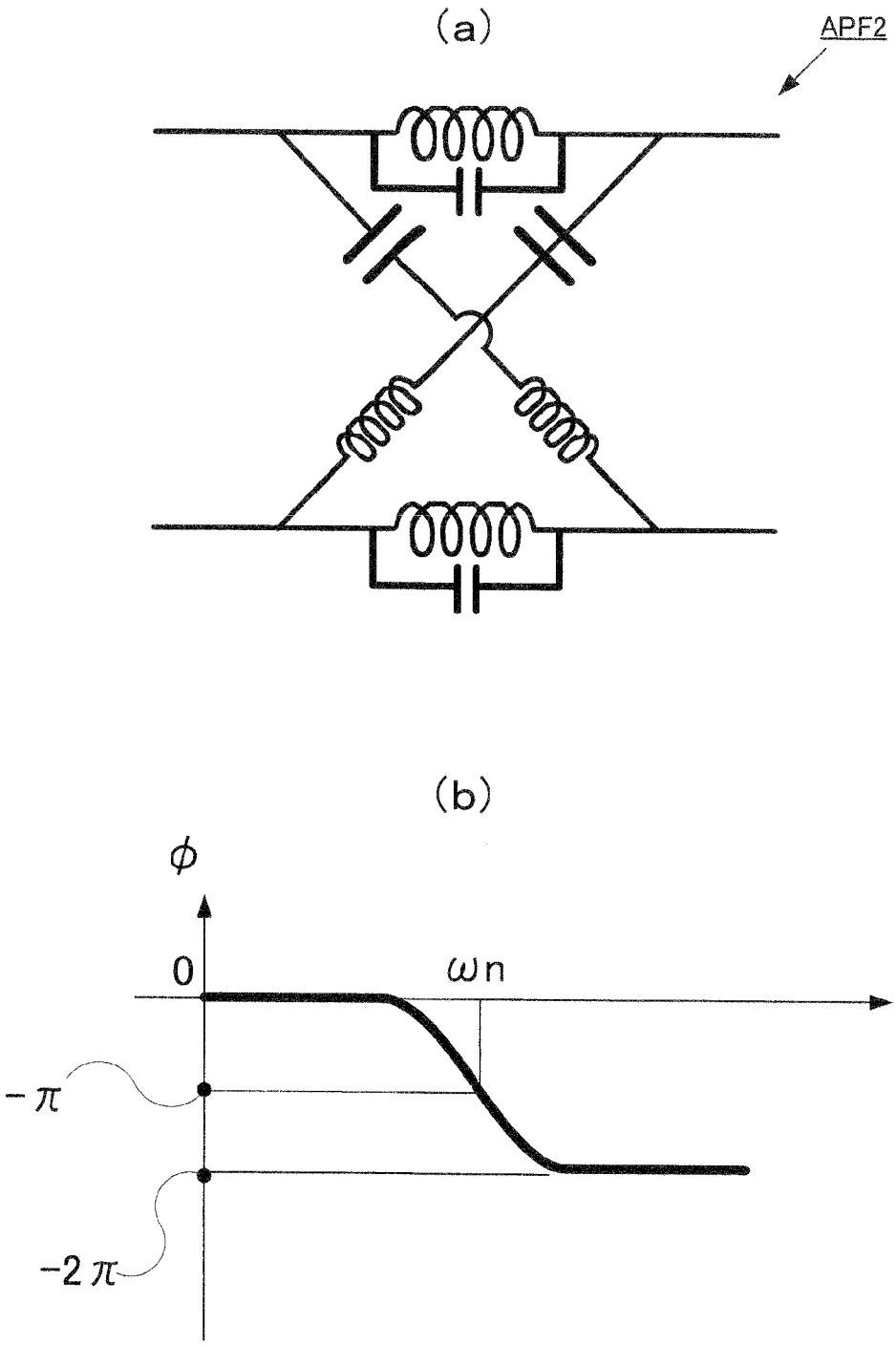

[FIG. 4]
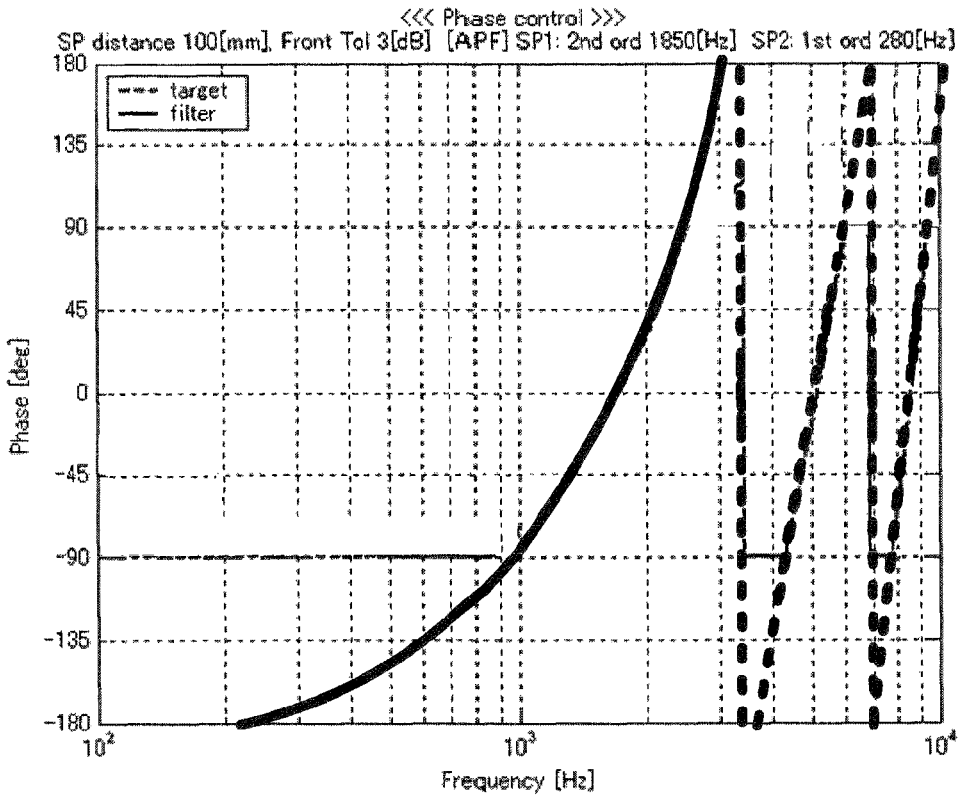

[FIG. 5]
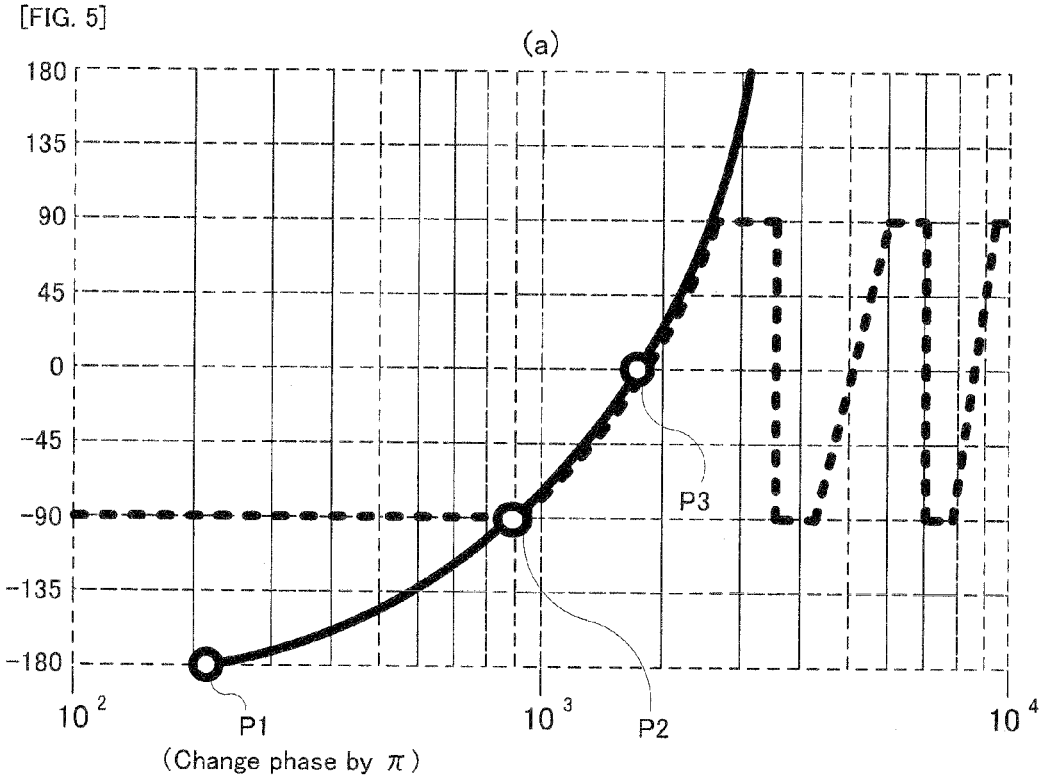
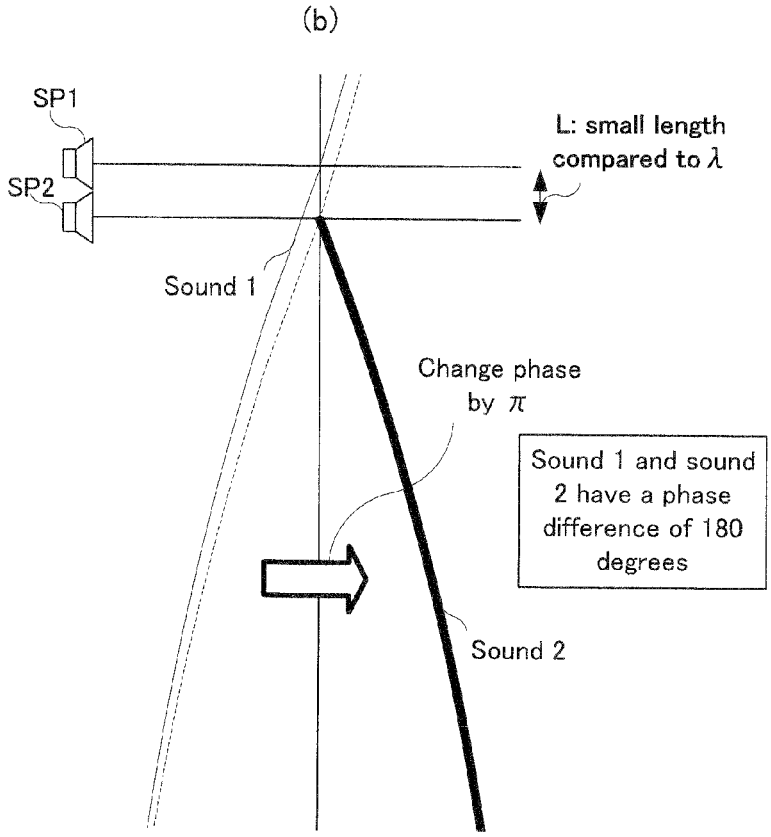

[FIG. 6]
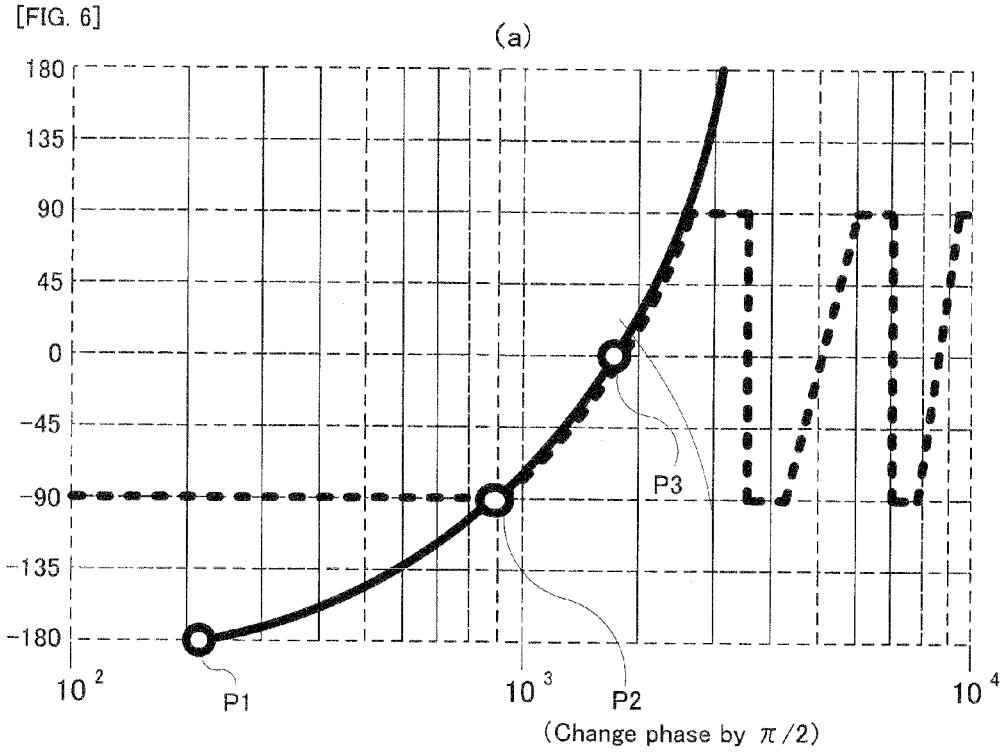
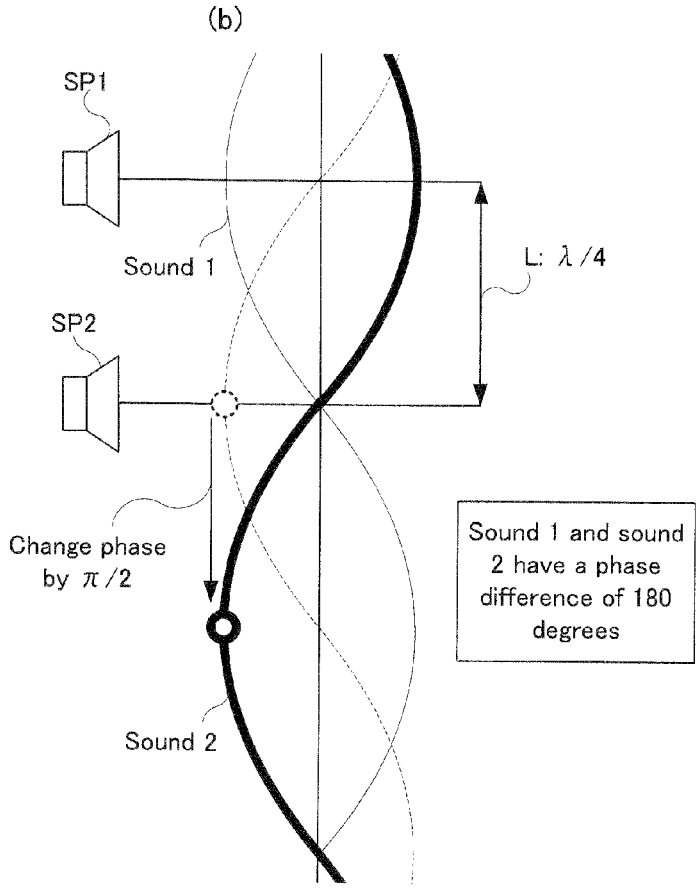

[FIG. 7]
(a)
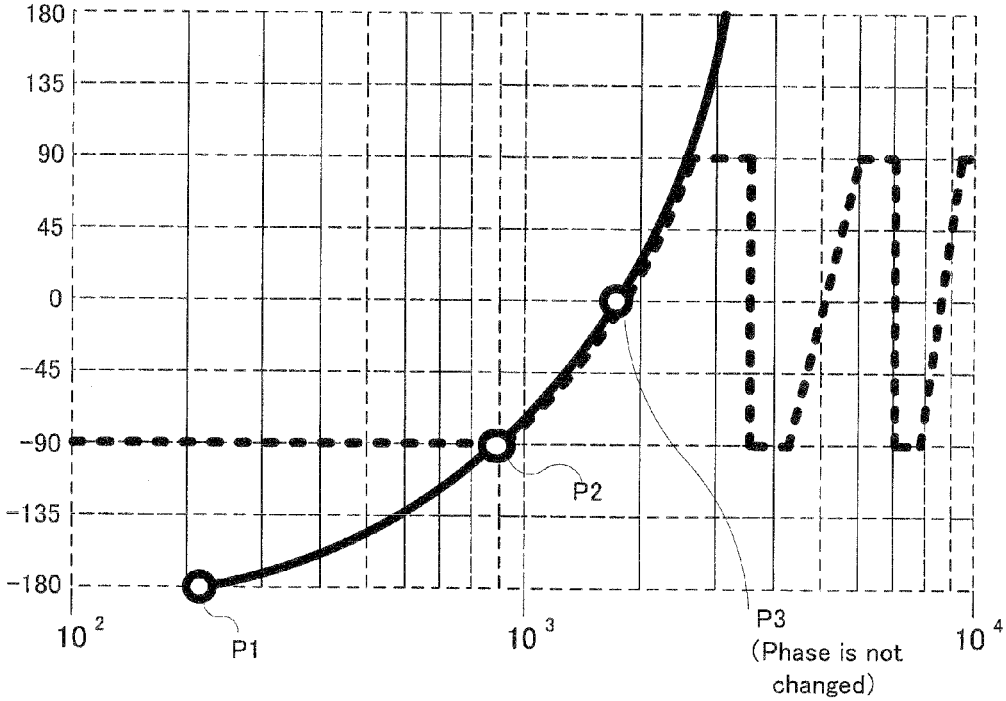
(b)
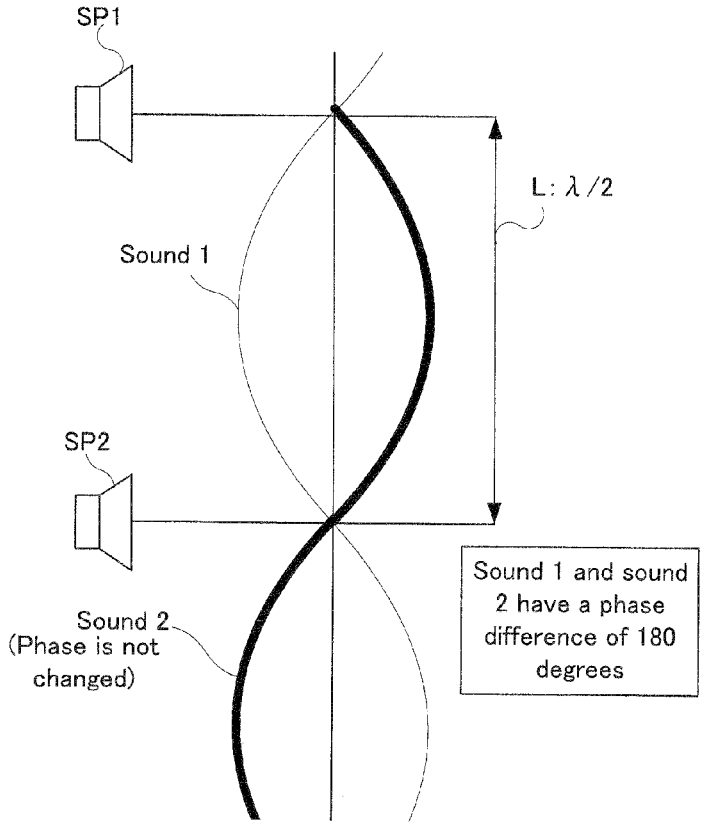

[FIG. 8]
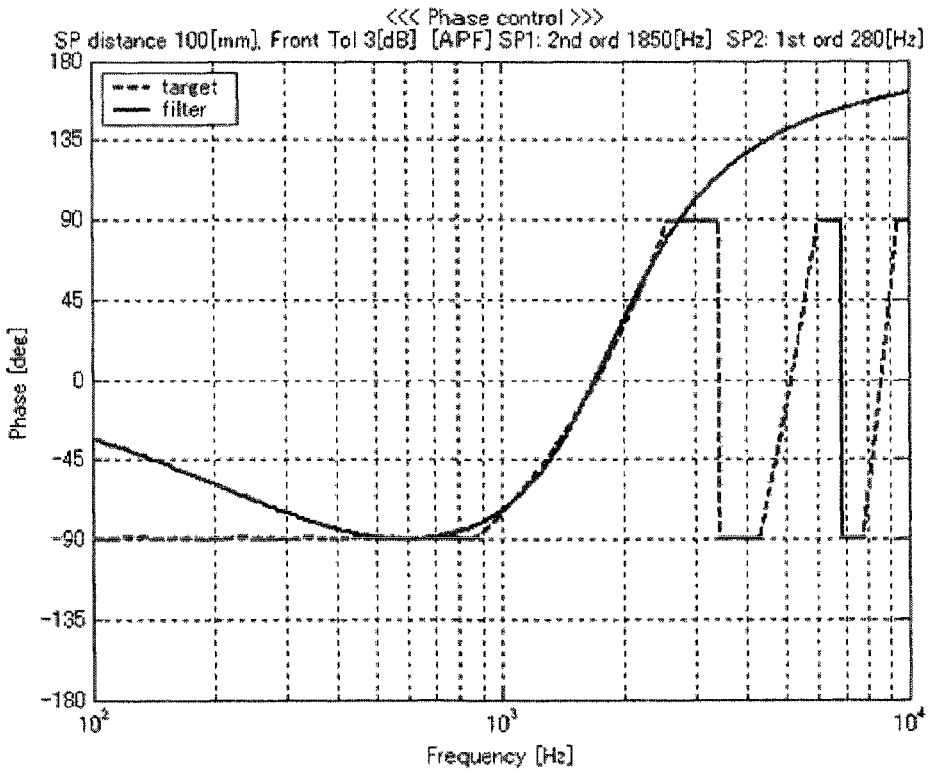

[FIG. 9]
(a)
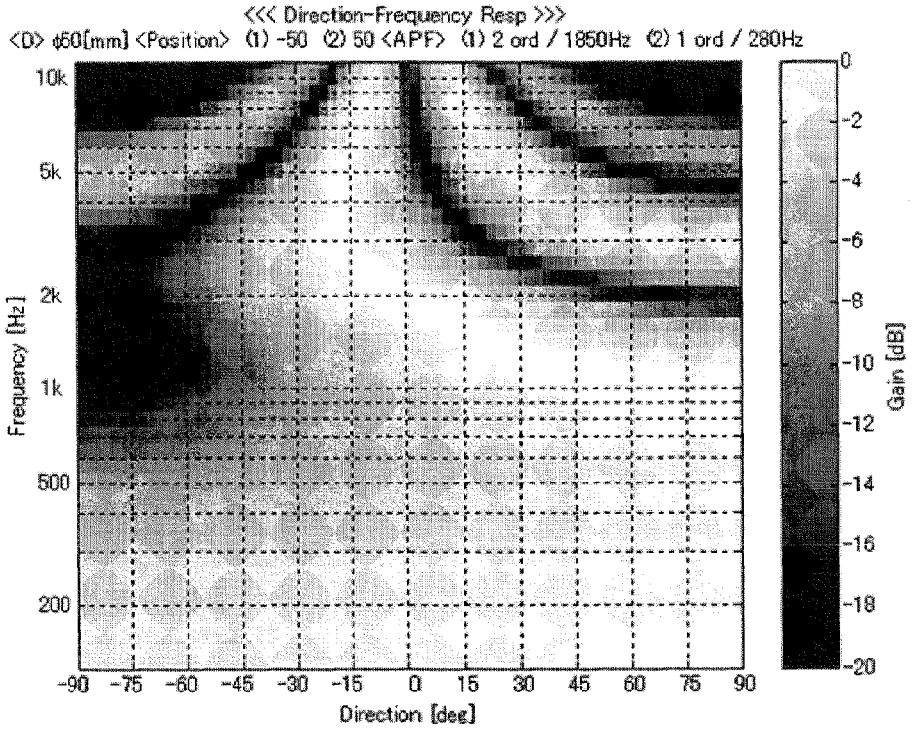
(b)
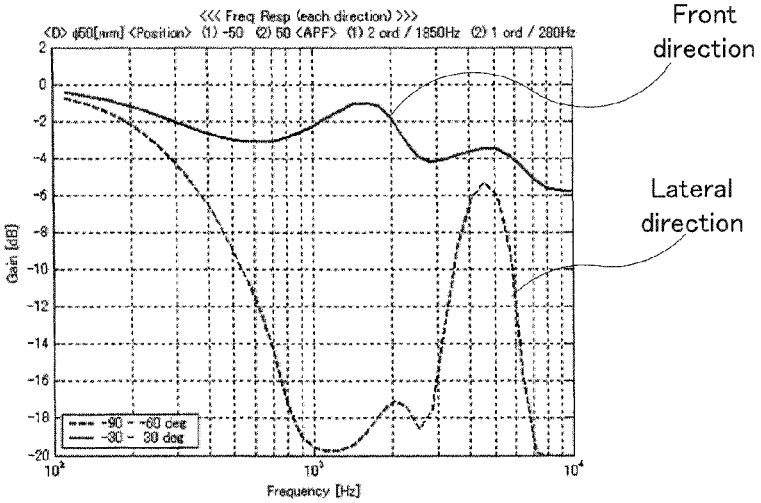

[FIG. 10]
(a)
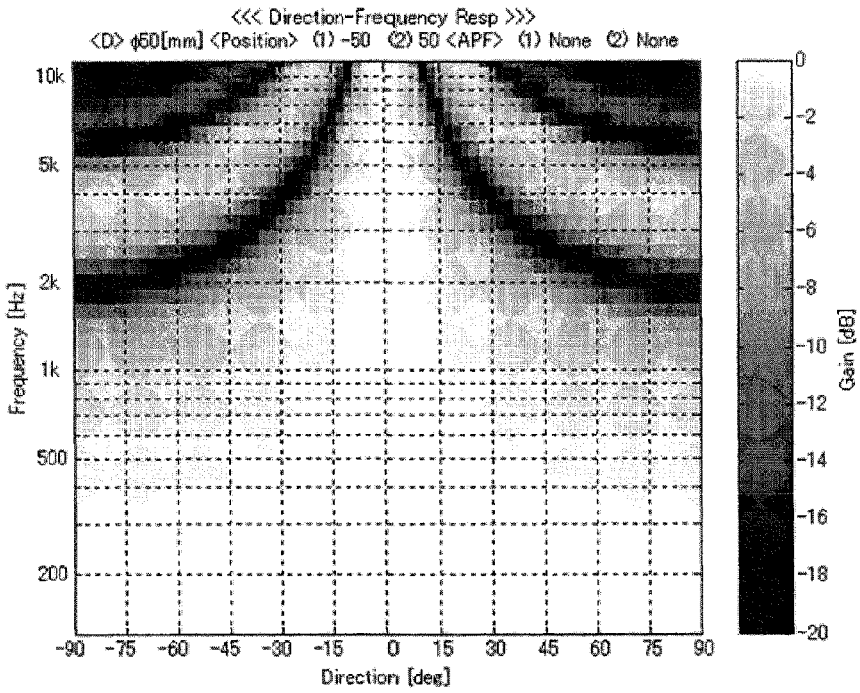
(b)
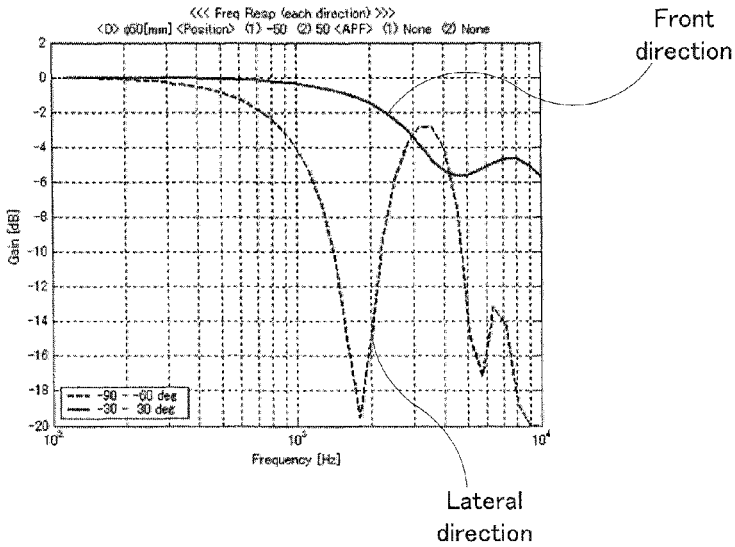

[FIG. 11]
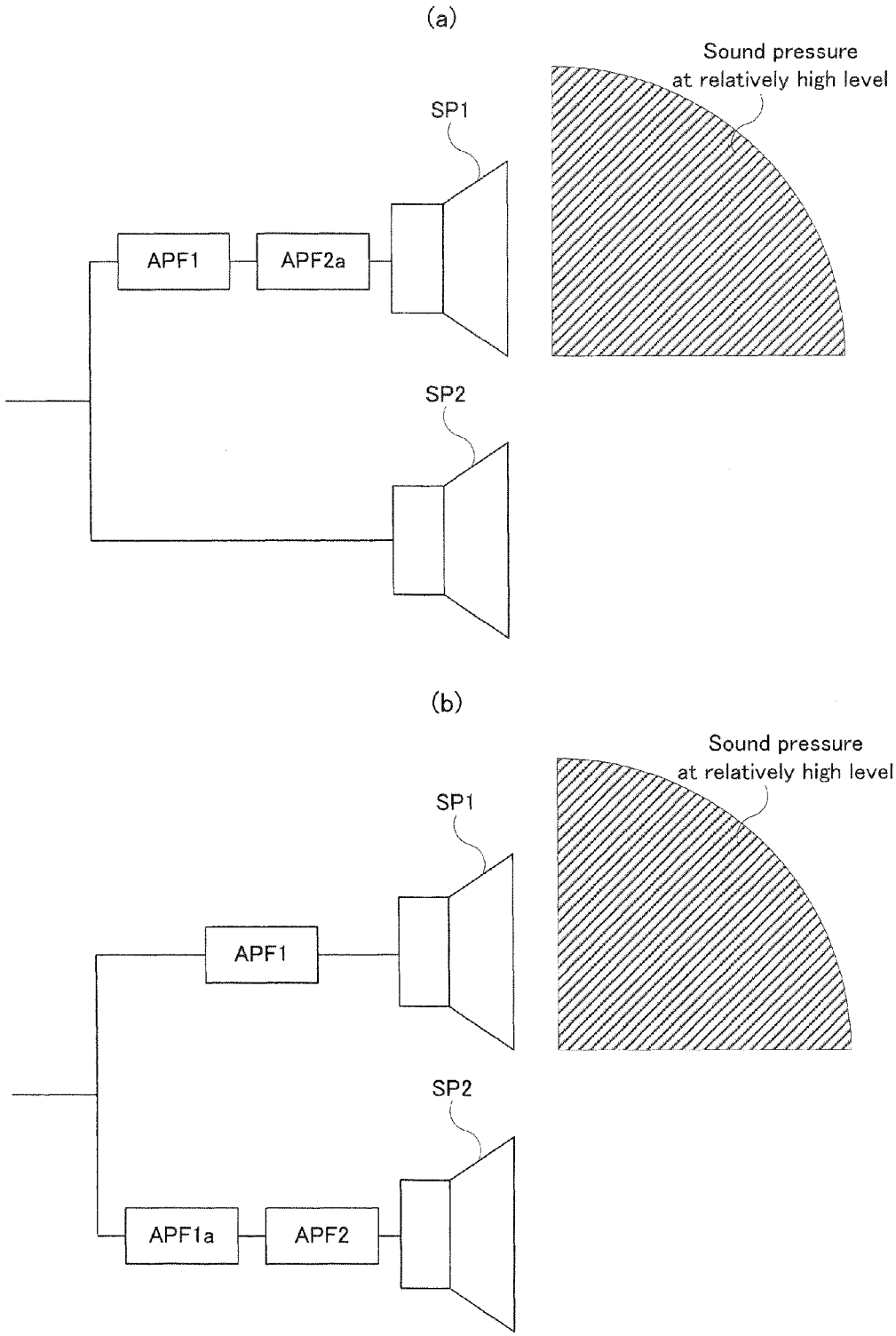

[FIG. 12]
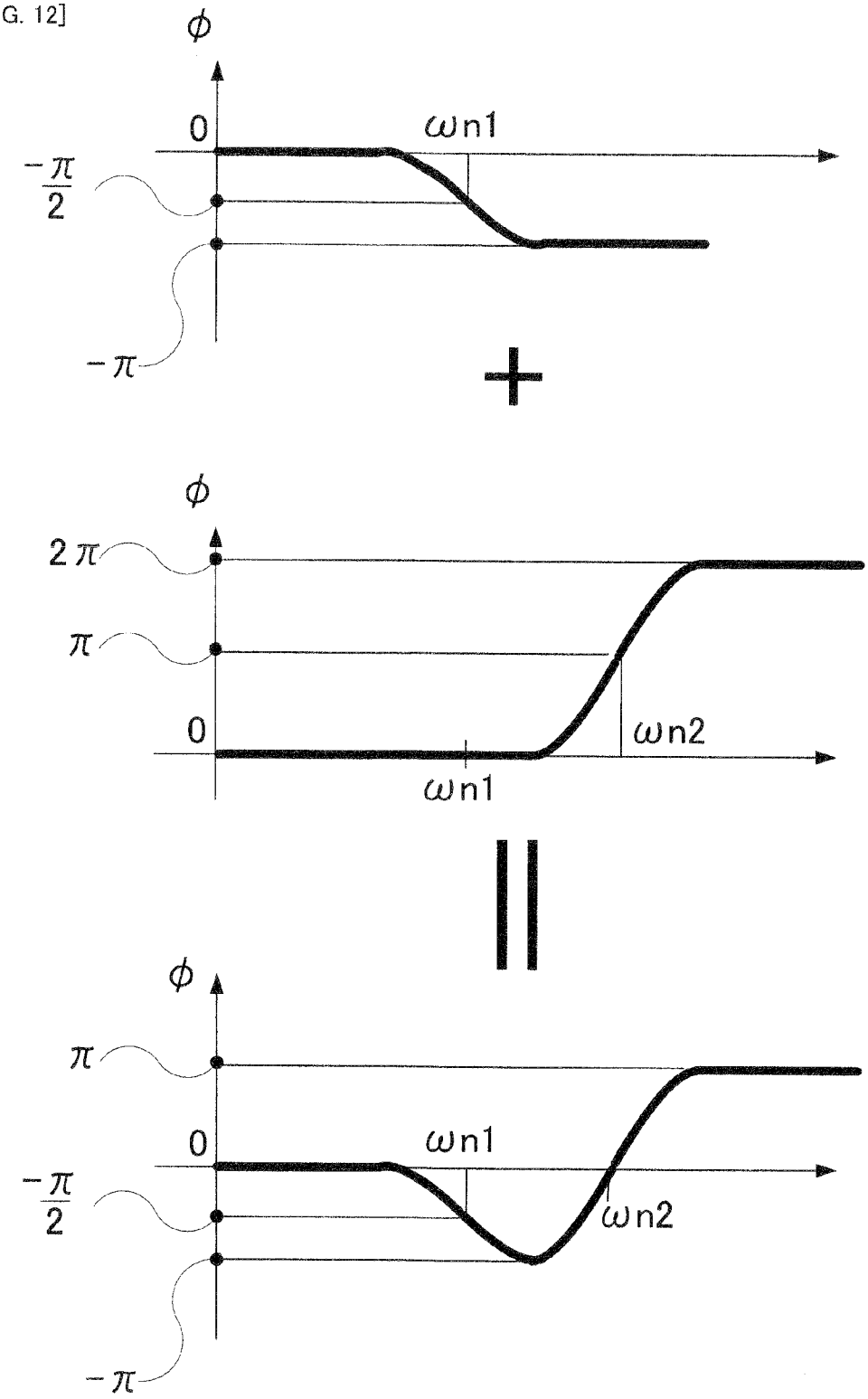

[FIG. 13]
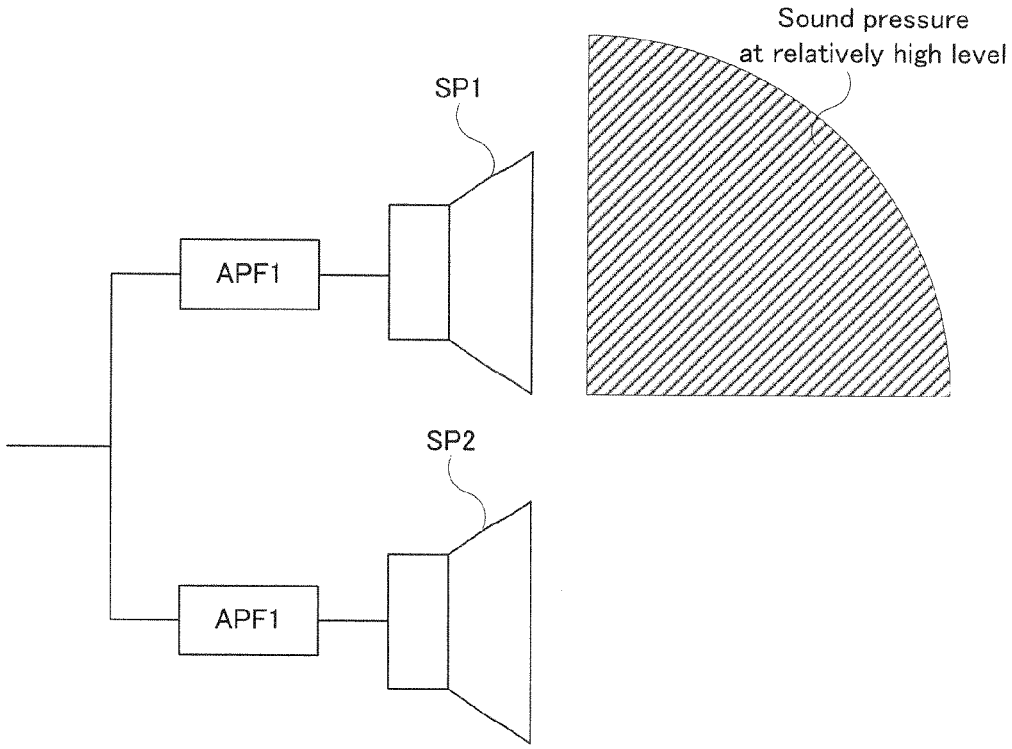

[FIG. 14]
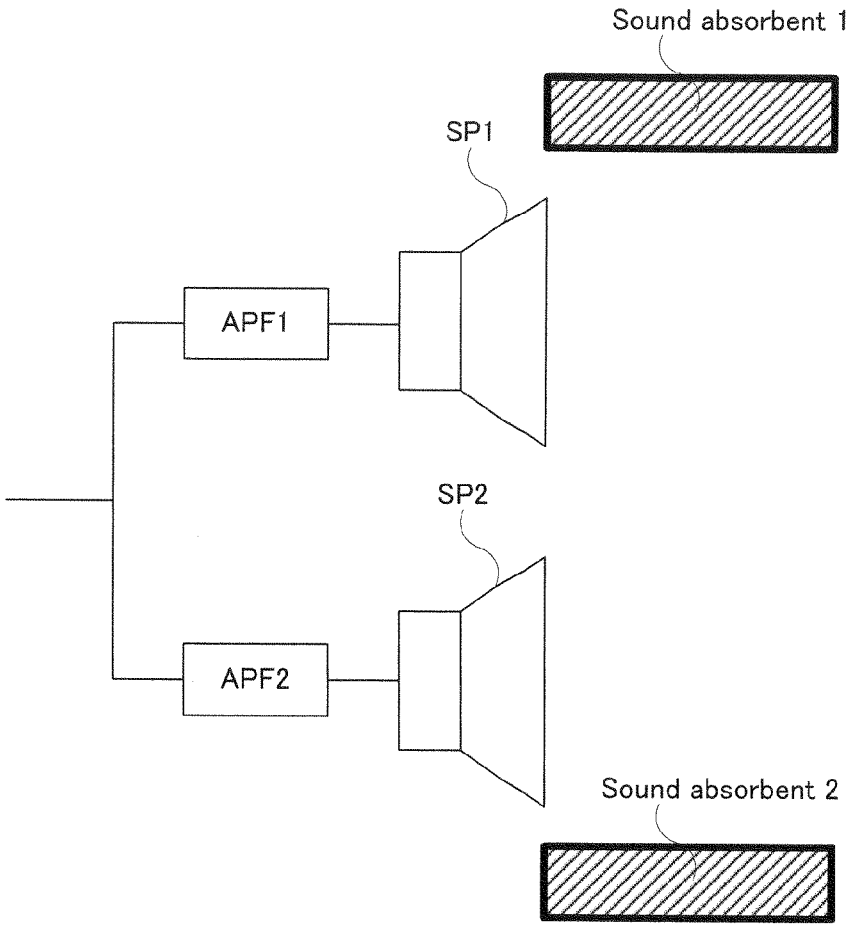

[FIG. 15]
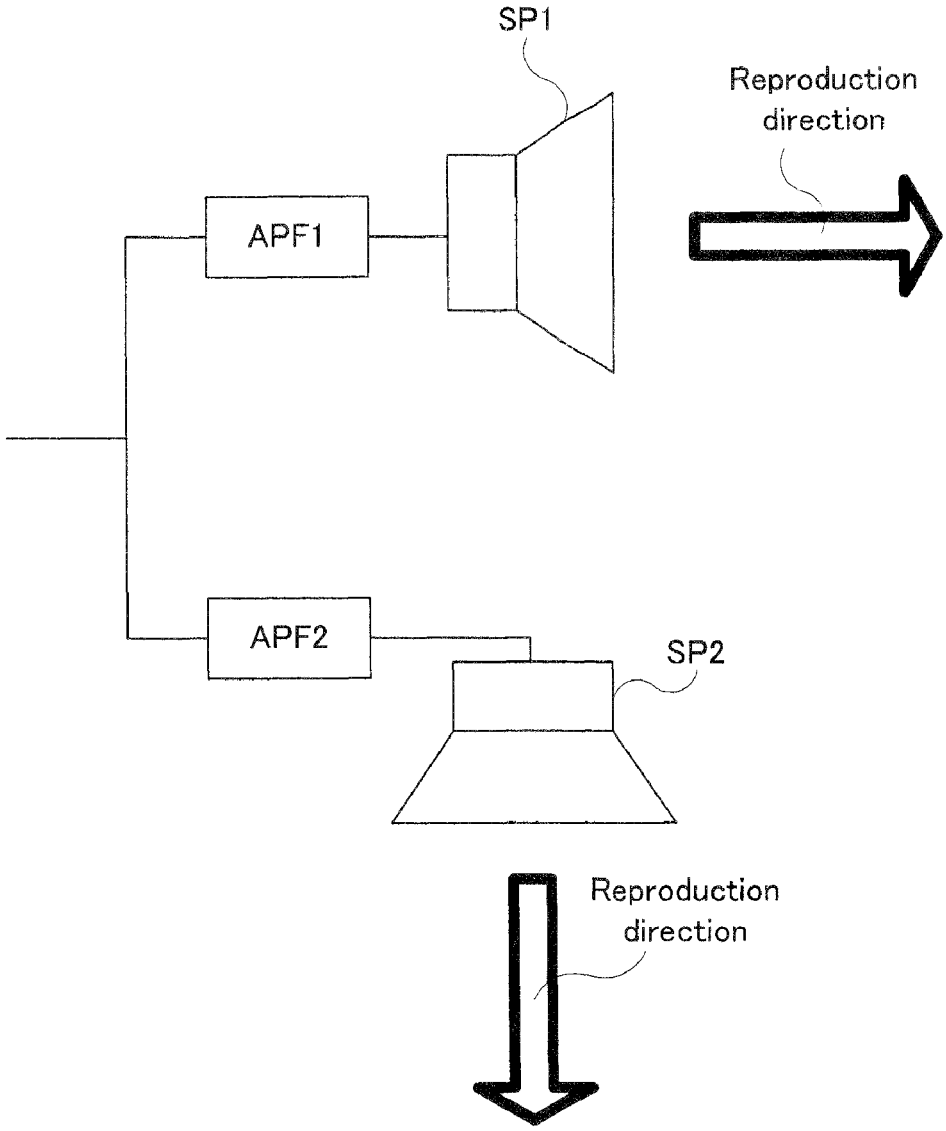

[FIG. 16]
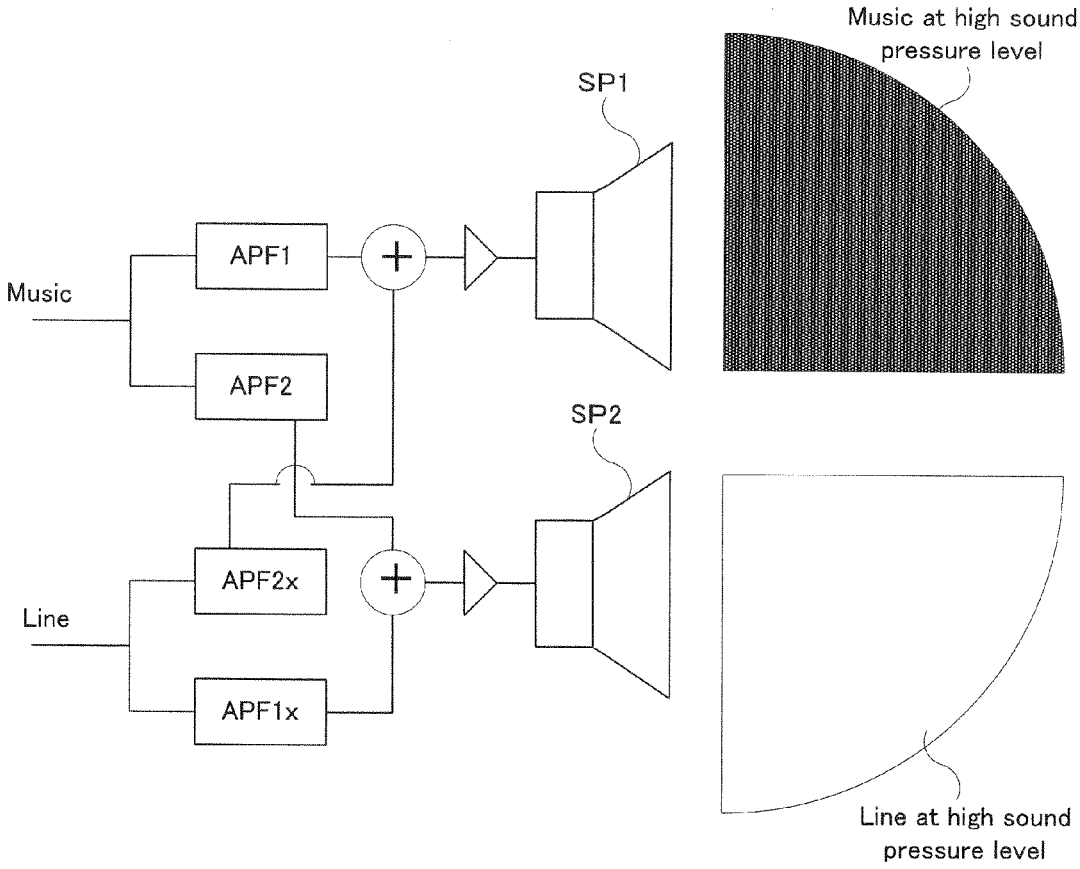

[FIG. 17]
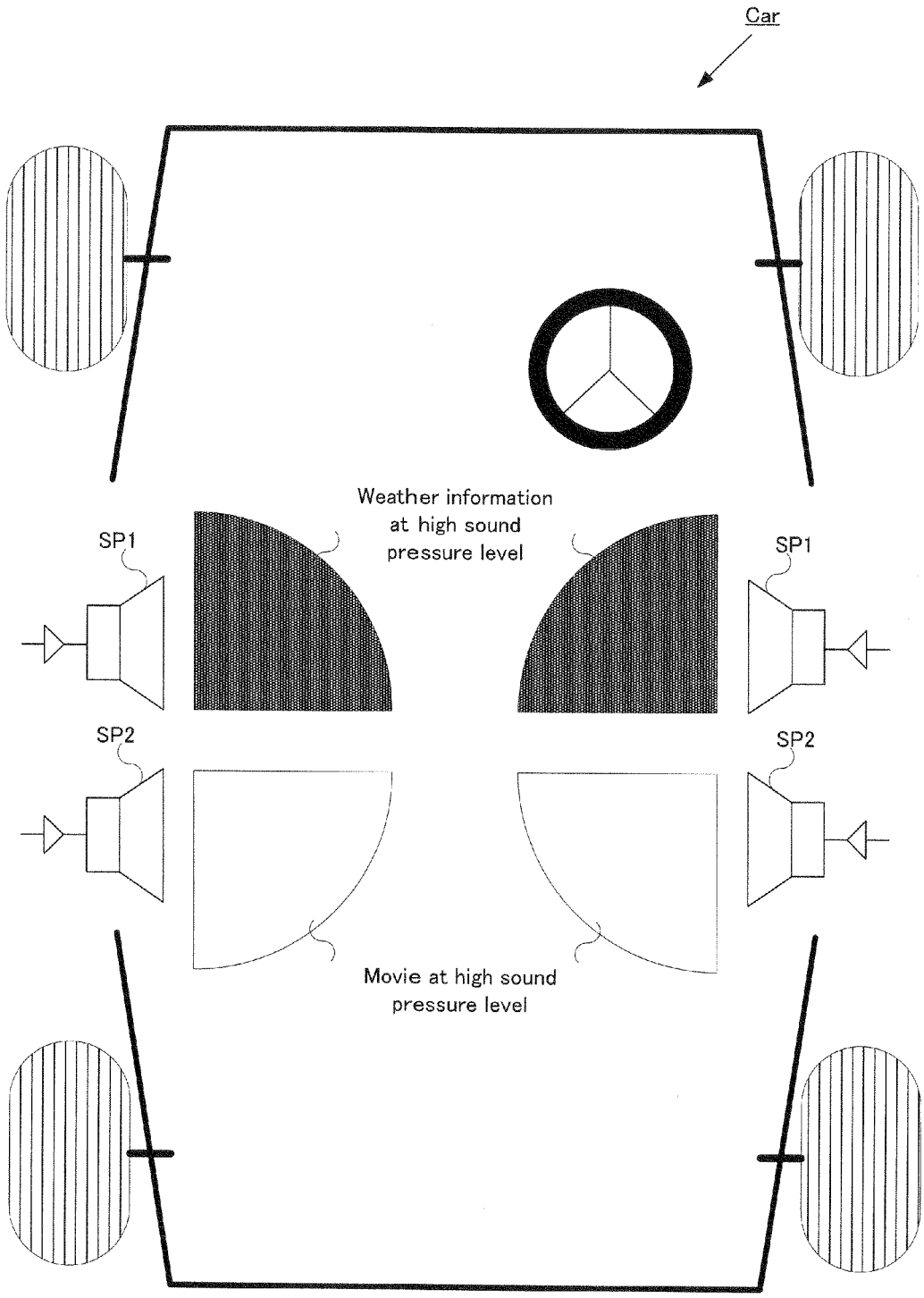

SPEAKER DEVICE WITH THE PHASE CHANGING DEVICE FOR VARYING THE PHASE OF THE AUDIO SIGNAL

TECHNICAL FIELD

The present invention relates to a speaker apparatus provided with at least two speakers having directionality in the reproduction direction of an audio signal, for example.

BACKGROUND ART

As a conventional speaker apparatus for performing reproduction while achieving the directionality in the reproduction direction of an audio signal, a tonzoile type speaker apparatus is generally known, for example. In the tonzoile type speaker apparatus, a plurality of speakers (or speaker units) are aligned in a lateral direction (i.e. horizontal direction) and separated by a predetermined distance. Of them, if attention is focused on two speakers disposed and separated by the predetermined distance, the audio signals reproduced from the two speakers are canceled because of a phase difference caused by the predetermined distance, with regard to sound waves emitted in the lateral direction, in a frequency corresponding to a wavelength twice as long as the predetermined distance. Incidentally, in a front direction, the audio signals reproduced from the two speakers are combined, and a sound pressure level increases. Thus, it is generally known that there is a significant difference in sound level, between the sound pressure level in the front direction and the sound pressure level in the lateral direction. Moreover, in a patent document 1 and the like, such methods are suggested that the tonzoile type speaker apparatus is developed.

Patent document 1: Japanese Patent Publication NO. 2528178

Patent document 2: Japanese Patent Publication NO. 2675388

Patent document 3: Japanese Patent Publication NO. 2846363

Patent document 4: Japanese Patent Publication NO. 3473517

Patent document 5: Japanese Patent Publication NO. 3422281

Patent document 6: Japanese Patent Publication NO. 3422282

Patent document 7: Japanese Patent Publication NO. 3422296

Patent document 8: Japanese Patent Publication NO. 3205625

Patent document 9: Japanese Patent Publication NO. 2574454

DISCLOSURE OF INVENTION

Subject to be Solved by the Invention

However, the speaker apparatus which achieves the directionality on the basis of the conventional tonzoile method described above, has such a technical problem that the predetermined distance at which the two speakers are disposed causes a low-frequency limit in a range of the frequency (i.e. frequency band) that can achieve the directionality in the reproduction signal. Specifically, the frequency corresponding to the wavelength twice as long as the predetermined distance between the two speakers is at the low-frequency limit.

In view of the aforementioned problems, it is therefore an object of the present invention to provide a speaker apparatus which can achieve the directionality in a wider frequency band, in an audio signal reproduced from two speakers, for example.

Means for Solving the Subject (Speaker Apparatus)

Hereinafter, the speaker apparatus of the present invention will be explained.

The above object of the present invention can be achieved by a speaker apparatus provided with: a first speaker which reproduces an audio signal; and a second speaker which reproduces the audio signal and which is disposed and separated from the first speaker by a predetermined distance in a horizontal direction, at least one of the first speaker and the second speaker having a phase changing device for changing a phase of the audio signal by a predetermined amount of phase on the basis of (i) a frequency of the audio signal and (ii) the predetermined distance.

According to the speaker apparatus of the present invention, the second speaker, which reproduces the audio signal, has substantially the same emitting direction to emit a sound wave, as that of the first speaker, which reproduces the audio signal. Moreover, the second speaker is disposed and separated from the first speaker by the predetermined distance in the horizontal direction.

In particular, according to the present invention, by the phase changing device owned by at least one of the first speaker and the second speaker, the phase of the audio signal is changed by the predetermined amount of phase, on the basis of (i) the frequency of the audio signal and (ii) the predetermined distance. Specifically, the phase changing device firstly determines the predetermined amount of phase, which is obtained by subtracting the phase corresponding to the predetermined distance from 180 degrees (i.e. $\pi$), for example, on the basis of (i) a wavelength corresponding to the frequency of the audio signal and (ii) the predetermined distance between the first speaker and the second speaker. Then, the phase changing device changes, such as advances or delays, the phase of the audio signal to be reproduced by at least one of the first speaker and the second speaker, by the determined predetermined amount of phase.

More specifically, for example, if the wavelength corresponding to the frequency of the audio signal is about several to several hundred times longer than the predetermined distance between the first speaker and the second speaker, the phase of the audio signal to be reproduced by at least one of the first speaker and the second speaker is changed, such as advanced or delayed, for example, by about 180 degrees (i.e. $\pi$), as the predetermined amount of phase. Therefore, there is a phase difference of about 180 degrees (i.e. $\pi$), for example, between the phase of a sound wave emitted from the first speaker (hereinafter referred to as a "first sound wave", as occasion demands) and the phase of a sound wave emitted from the second speaker (hereinafter referred to as a "second sound wave", as occasion demands).

Alternatively, if the predetermined distance between the first speaker and the second speaker is about ¼ of the wavelength corresponding to the frequency of the audio signal, for example, the phase of the audio signal to be reproduced by at least one of the first speaker and the second speaker is changed, such as advanced or delayed, for example, by about 90 degrees (i.e. $\pi/2$), as the predetermined amount of phase. Therefore, there is a phase difference of about 180 degrees (i.e. $\pi$) for example, between the phase of the first sound wave emitted from the first speaker and the phase of the second sound wave emitted from the second speaker.

Alternatively, if the predetermined distance between the first speaker and the second speaker is about ½ of the wavelength corresponding to the frequency of the audio signal, for example, the phase of the audio signal to be reproduced by at least one of the first speaker and the second speaker, is changed, such as advanced or delayed, for example, by 0 degree, as the predetermined amount of phase, i.e. is not changed. Therefore, there is a phase difference of about 180 degrees (i.e. π), for example, between the phase of the first sound wave emitted from the first speaker and the phase of the second sound wave emitted from the second speaker.

As a result, for example, in any one of the lateral direction (or horizontal direction), i.e. in either the right direction or the left direction, the first sound wave emitted from the first speaker and the second sound wave emitted from the second speaker are canceled on the basis of a phase difference of about 180 degrees (i.e. π), for example, and the sound pressure level corresponding to the frequency of the audio signal can be set to almost zero.

On the other hand, in the front direction, the sound pressure level of the combined sound wave of the first sound wave and the second sound wave, is maintained at a normal level in which there is little influence or no influence of the interference of the sound waves. Moreover, in the other direction of the right direction and the left direction, the sound pressure level of either the first sound wave or the second sound wave, is maintained at the normal level in which there is little influence or no influence of the interference of the sound waves.

As a result, the sound pressure level of the sound waves emitted from the first speaker and the second speaker, is relatively reduced in any one of the lateral direction (or horizontal direction), i.e. in either the right direction or the left direction. At the same time, the sound pressure level is relatively increased (i) in the front direction and (ii) in either the right direction or the left direction). Therefore, it is possible to make the sound waves emitted from the first speaker and the second speaker, properly maintain the directionality.

In one aspect of the speaker apparatus of the present invention, the phase changing device (i) reduces the predetermined amount as the frequency of the audio signal approaches a reference frequency corresponding to a wavelength almost twice as long as the predetermined distance and (ii) increases the predetermined amount as the frequency of the audio signal departs from the reference frequency.

According to this aspect, it is possible to clearly and properly define a phase characteristic of the phase changing device, which indicates the amount of phase change determined with the frequency as a parameter, on the basis of a comparison between the frequency and the reference frequency, in order to provide e.g. a phase difference of about 180 degrees (i.e. π) between the phase of the audio signal to be reproduced by the first speaker and the phase of the audio signal to be reproduced by the second speaker. Incidentally, the reference frequency can be defined, highly accurately, on the basis of the speed of sound in the air.

In another aspect of the speaker apparatus of the present invention, the phase changing device sets the predetermined amount to be almost zero if the frequency of the audio signal is substantially equal to a reference frequency corresponding to a wavelength almost twice as long as the predetermined distance.

According to this aspect, it is possible to clearly and properly define the phase characteristic of the phase changing device, on the basis of the reference frequency, in order to provide e.g. a phase difference of about 180 degrees (i.e. π) between the phase of the audio signal to be reproduced by the first speaker and the phase of the audio signal to be reproduced by the second speaker.

In another aspect of the speaker apparatus of the present invention, the phase changing device sets a reference frequency corresponding to a wavelength almost twice as long as the predetermined distance, in a predetermined range corresponding to a human voice (e.g. "200 to 3 k" Hz).

According to this aspect, in the predetermined range corresponding to the human voice (e.g. "200 to 3 k" Hz), the sound pressure level of the sound waves emitted from the first speaker and the second speaker, can be relatively reduced in any one of the lateral direction, i.e. in either the right direction or the left direction. Moreover, it is possible to make the emitted sound waves, properly maintain the directionality.

In another aspect of the speaker apparatus of the present invention, the phase changing device performs the changing by the predetermined amount of phase (about 90 degrees), on the basis of a sound pressure level of a combined sound wave obtained by combining a first sound wave emitted from the first speaker and a second sound wave emitted from the second speaker.

According to this aspect, it is possible to define the sound pressure level of the combined sound wave, which is emitted in the front direction crossing the horizontal direction at right angles, on the basis of the predetermined amount of phase difference. Specifically, for example, with regard to the combined sound wave (e.g. sound pressure level: +3(dB: decibel)) when the predetermined amount of phase difference is about 90 degrees, it is possible to limit a reduction in the sound pressure level to about 3 (dB), on the basis of the sound pressure level of the combined sound (e.g. sound pressure level: +6(dB: decibel)) in which the phase difference between the first sound wave and the second sound wave is about 0 degree.

In another aspect of the speaker apparatus of the present invention, the phase changing device is a filter circuit including an inductor or a capacitor.

According to this aspect, it is possible to easily achieve the phase changing device which is in a small size, at low cost, on the basis of the filter circuit.

In another aspect of the speaker apparatus of the present invention, the phase changing device is an all-pass filter circuit including an inductor or a capacitor.

According to this aspect, it is possible to easily achieve the phase changing device which is in a small size and which has a less signal loss, at low cost, on the basis of the all-pass filter circuit.

In another aspect of the speaker apparatus of the present invention, the phase changing device includes at least one of (i) a first-order filter circuit for changing the audio signal by a phase of a first angle (e.g. 180 degrees) and (ii) a second-order filter circuit for changing the audio signal by a phase of a second angle (e.g. 360 degrees).

According to this aspect, it is possible to easily achieve the small-sized phase changing device at low cost, on the basis of the first-order filter circuit and the second-order filter circuit.

In an aspect associated with the phase changing device described above, the phase changing device may include (i) a dual second-order filter circuit which maintains a dual relationship with the second-order filter circuit, in addition to or instead of the first-order filter circuit, or (ii) a dual first-order filter circuit which maintains a dual relationship with the first-order filter circuit, in addition to or instead of the second-order filter circuit.

By virtue of such construction, it is possible to easily achieve the small-sized phase changing device at low cost, on the basis of the dual second-order filter circuit and the dual first-order filter circuit. Here, the "dual relationship" in the present invention means a relationship having such a structure that the inductor and the capacitor are replaced, in the first-order filter. Moreover, the "dual relationship" in the second-order filter means a relationship having such a structure that a serial resonance circuit and a parallel resonance circuit are replaced.

In another aspect of the speaker apparatus of the present invention, at least one of the first speaker and the second speaker has one phase changing device corresponding to one audio signal, and at least the other of the first speaker and the second speaker has another phase changing device corresponding to another audio signal.

According to this aspect, on the basis of the one phase changing device, in any one (e.g. the second speaker side) of the lateral direction, i.e. in either the right direction or the left direction, the first sound wave emitted from the first speaker (i.e. the first sound wave corresponding to the one audio signal) and the second sound wave emitted from the second speaker (i.e. the second sound wave corresponding to the one audio signal) are canceled on the basis of a phase difference of about 180 degrees (i.e. $\pi$), for example, and the sound pressure level corresponding to the frequency of the audio signal, can be set to almost zero. On the other hand, in the front direction, the sound pressure level of the combined sound wave of the first sound wave (i.e. the first sound wave corresponding to the one audio signal) and the second sound wave (i.e. the second sound wave corresponding to the one audio signal) is maintained (only on the basis of the phase difference of the audio signals), at a normal level in which there is little influence or no influence of the interference of the sound waves. Moreover, in the other direction (e.g. the first speaker side) of the right direction and the left direction, the sound pressure level of the first sound wave (i.e. the first sound wave corresponding to the one audio signal) is maintained at the normal level in which there is little influence or no influence of the interference of the sound waves.

As a result, the sound pressure level of the emitted sound waves (i.e. the first sound wave and the second sound wave corresponding to the one audio signal) is relatively reduced in any one (e.g. the second speaker side) of the lateral direction, i.e. in either the right direction or the left direction. At the same time, the sound pressure level is relatively increased (i) in the front direction and (ii) in either the right direction or the left direction). Therefore, it is possible to make the sound waves emitted from the first speaker and the second speaker (i.e. the first sound wave and the second sound wave corresponding to the one audio signal), properly maintain the directionality.

Substantially in the same manner, on the basis of the another phase changing device, in any one (e.g. the first speaker side) of the lateral direction, i.e. in either the right direction or the left direction, the first sound wave emitted from the first speaker (i.e. the first sound wave corresponding to the another audio signal) and the second sound wave emitted from the second speaker (i.e. the second sound wave corresponding to the another audio signal) are canceled on the basis of a phase difference of about 180 degrees (i.e. $\pi$), for example, and the sound pressure level corresponding to the frequency of the audio signal can be set to almost zero. On the other hand, in the front direction, the sound pressure level of the combined sound wave of the first sound wave (i.e. the first sound wave corresponding to the another audio signal) and the second sound wave (i.e. the second sound wave corresponding to the another audio signal) is maintained (only on the basis of the phase difference of the audio signals), at a normal level in which there is little influence or no influence of the interference of the sound waves. Moreover, in the other direction (e.g. the second speaker side) of the right direction and the left direction, the sound pressure level of the second sound wave (i.e. the second sound wave corresponding to the another audio signal) is maintained at the normal level in which there is little influence or no influence of the interference of the sound waves.

As a result, the sound pressure level of the emitted sound waves (i.e. the first sound wave and the second sound wave corresponding to the another audio signal) is relatively reduced in any one (e.g. the first speaker side) of the lateral direction, i.e. in either the right direction or the left direction. At the same time, the sound pressure level is relatively increased (i) in the front direction and (ii) in either the right direction or the left direction. Therefore, it is possible to make the sound waves emitted from the first speaker and the second speaker (i.e. the first sound wave and the second sound wave corresponding to the another audio signal), properly maintain the directionality.

Consequently, it is possible to make the sound waves which correspond to a plurality of audio signals and which are emitted from the first speaker SP1 and the second speaker SP2 for reproducing the different plurality of audio signals, properly maintain the directionality.

In another aspect of the speaker apparatus of the present invention, the phase changing device is a digital filter circuit.

According to this aspect, it is possible to easily achieve the small-sized phase changing device at low cost, on the basis of the digital filter circuit.

In another aspect of the speaker apparatus of the present invention, the first speaker and the second speaker have substantially the same reproduction direction and are aligned in the horizontal direction, and the speaker apparatus is further provided with a sound absorbent near an outer side of the first speaker and the second speaker.

According to this aspect, the sound pressure level of the sound waves emitted from the first speaker and the second speaker can be relatively reduced in any one of the lateral direction, i.e. in either the right direction or the left direction, on the basis of the sound absorbent disposed near the outer side of the first speaker and the second speaker. Moreover, it is possible to make the emitted sound waves, properly maintain the directionality.

In another aspect of the speaker apparatus of the present invention, a reproduction direction of the first speaker and a reproduction direction of the second speaker are different by about 90 degrees.

According to this aspect, the sound pressure level of the sound waves emitted from the first speaker and the second speaker can be relatively reduced in any one of the lateral direction, i.e. in either the right direction or the left direction, on the basis of the second speaker which is disposed such that the reproduction direction is difference from the reproduction direction of the first speaker by about 90 degrees. Moreover, it is possible to make the emitted sound waves, properly maintain the directionality.

These effects and other advantages of the present invention will become more apparent from the embodiments explained below.

As explained above, according to the speaker apparatus of the present invention, it is provided with the first speaker, the second speaker, and the phase changing device. Therefore, the sound pressure level of the sound waves emitted from the first speaker and the second speaker can be relatively reduced in any one of the lateral direction, i.e. in either the right direction or the left direction. Moreover, it is possible to make the emitted sound waves, properly maintain the directionality.

BRIEF DESCRIPTION OF DRAWINGS

FIGs. 1 are a block diagram schematically showing the basic structure of a speaker apparatus in an embodiment (FIG. 1(*a*)), and a schematic diagram schematically showing the placement of the speaker apparatus (FIG. 1(*b*)).

FIGs. 2 are a circuit diagram schematically showing the structure of a first-order filter circuit in the embodiment (FIG. 2(*a*)), and a graph schematically showing the phase characteristic of the first-order filter circuit (FIG. 2(*b*)).

FIGs. 3 are a circuit diagram schematically showing the structure of a second-order filter circuit in the embodiment (FIG. 3(*a*)), and a graph schematically showing the phase characteristic of the second-order filter circuit (FIG. 3(*b*)).

FIG. 4 is a graph showing one specific example of the phase characteristic which indicates the amount of phase change determined with the frequency as a parameter, in the embodiment.

FIGs. 5 are a graph showing one specific example of the phase characteristic in the embodiment (FIG. 5(*a*)), and a schematic diagram schematically showing a basic principle when a phase is changed by 180 degrees in the phase characteristic in the embodiment (FIG. 5(*b*)).

FIGs. 6 are a graph showing one specific example of the phase characteristic in the embodiment (FIG. 6(*a*)), and a schematic diagram schematically showing the basic principle when the phase is changed by 90 degrees in the phase characteristic in the embodiment (FIG. 6(*b*)).

FIGs. 7 are a graph showing one specific example of the phase characteristic in the embodiment (FIG. 7(*a*)), and a schematic diagram schematically showing the basic principle when the phase is not changed in the phase characteristic in the embodiment (FIG. 7(*b*)).

FIG. 8 is a graph showing another specific example of the phase characteristic which indicates the amount of phase change determined with the frequency as the parameter, in the embodiment.

FIGs. 9 are a graph showing a relationship among an angle in a directional direction in which a sound is emitted, a frequency, and a sound pressure level in the embodiment (FIG. 9(*a*)), and a graph showing a relationship between the sound pressure level and the frequency in the embodiment (FIG. 9(*b*)).

FIGs. 10 are a graph showing a relationship between the angle in the directional direction in which the sound is emitted and the frequency in a comparison example (FIG. 10(*a*)), and a graph showing a relationship between the sound pressure level and the frequency in the comparison example (FIG. 10(*b*)).

FIGs. 11 are block diagrams schematically showing one and another basic structures of a speaker apparatus in another embodiment (ver. 1) (FIG. 11(*a*) and FIG. 11(*b*)).

FIG. 12 is a graph schematically showing the phase characteristic combined on the filter circuits provided for the speaker apparatus in another embodiment (ver. 1).

FIG. 13 is a block diagram schematically showing another basic structure of the speaker apparatus in another embodiment (ver. 1).

FIG. 14 is a block diagram schematically showing another basic structure of a speaker apparatus in another embodiment (ver. 2).

FIG. 15 is a block diagram schematically showing another basic structure of a speaker apparatus in another embodiment (ver. 3).

FIG. 16 is a block diagram schematically showing another basic structure of a speaker apparatus in another embodiment (ver. 4).

FIG. 17 is a schematic diagram schematically showing an application example of the speaker apparatus in another embodiment (ver. 4).

DESCRIPTION OF REFERENCE CODES

SP1 first speaker
SP2 second speaker
APF1 first-order filter circuit
APF2 second-order filter circuit

BEST MODE FOR CARRYING OUT THE INVENTION

Hereinafter, the best mode for carrying out the present invention will be explained in each embodiment in order with reference to the drawings.

(1) Speaker Apparatus in Embodiment

Next, with reference to FIGS. 1 to FIGS. 3, a detailed explanation will be given on a speaker apparatus in the embodiment.

(1-1) Basic Structure

Firstly, with reference to FIG. 1, an explanation will be given on the speaker apparatus in the embodiment. FIG. 1 are a block diagram schematically showing the basic structure of the speaker apparatus in the embodiment (FIG. 1(*a*)), and a schematic diagram schematically showing the placement of the speaker apparatus (FIG. 1(*b*)).

As shown in FIG. 1(*a*), a speaker SP in the embodiment is provided with: a first speaker SP1 for reproducing an audio signal and emitting a sound wave; a second speaker SP2 for reproducing an audio signal and emitting a sound wave; a first-order filter circuit APF1 connected to the first speaker SP1; and a second-order filter circuit APF2 connected to the second speaker SP2. Incidentally, the first speaker SP1 and the second speaker SP2 may have an amplifier, inside or outside thereof. Moreover, the first-order filter circuit APF1 and the second-order filter circuit APF2 constitute one specific example of the "phase changing device" of the present invention. Moreover, as shown in FIG. 1(*b*), the first speaker SP1 and the second speaker SP2 stored in one case, are aligned in a horizontal direction. The first speaker SP1 and the second speaker SP2 are separated by a predetermined distance "L" in the horizontal direction. Then, the emitting or radiation direction of a combined sound wave of the sound wave emitted from the first speaker and the sound wave emitted from the second speaker, is a direction substantially crossing the horizontal direction. Incidentally, the first speaker SP1 and the second speaker SP2 may be stored in two cases, separately and respectively.

In particular, in the embodiment, as shown in FIG. 1(*a*), the sound pressure level of the sound waves emitted from the first speaker SP1 and the second speaker SP2, is intended to be relatively reduced in any one (e.g. the second speaker SP2 side) of the lateral direction (or horizontal direction), i.e. in either the right direction or the left direction. At the same time, the sound pressure level is intended to be relatively increased (i) in the front direction and (ii) in either the right direction or the left direction). That is, it is a main purpose to make the emitted sound waves properly maintain the directionality.

(1-2) Detailed Structure

Next, with reference to FIG. 2 and FIG. 3, the detailed structure of the speaker apparatus in the embodiment will be explained. FIG. 2 are a circuit diagram schematically showing the structure of the first-order filter circuit in the embodiment (FIG. 2(*a*)), and a graph schematically showing the phase characteristic of the first-order filter circuit (FIG. 2(*b*)). FIG. 3 are a circuit diagram schematically showing the structure of the second-order filter circuit in the embodiment (FIG. 3(*a*)), and a graph schematically showing the phase characteristic of the second-order filter circuit (FIG. 3(*b*)).

As shown in FIG. 2(*a*), the first-order filter circuit APF1 may be a first-order all-pass filter including an inductor (e.g. coil), or a capacitor (e.g. condenser). The first-order filter circuit APF1, as shown in FIG. 2(*b*), has a constant amplitude characteristic (e.g. 0(dB)) and has such a physical property (i) that the amount of phase change is "−90 (degrees)" at a reference angular frequency "ωn" and (ii) that the amount of phase change is "−180 (degrees)" if the angular frequency exceeds the reference angular frequency "ωn". The first-order filter circuit APF1 is applied to the first speaker SP1, for example.

On the other hand, as shown in FIG. 3(*a*), the second-order filter circuit APF2 may be a second-order all-pass filter which is a lattice analog circuit including an inductor (e.g. coil), or a capacitor (e.g. condenser). The second-order filter circuit APF2, as shown in FIG. 3(*b*), has a constant amplitude characteristic (e.g. 0(dB)) and has such a physical property (i) that the amount of phase change is "−180 (degrees)" at the reference angular frequency "ωn" and (ii) that the amount of phase change is "360 (degrees)" if the angular frequency exceeds the reference angular frequency "ωn". The second-order filter circuit APF2 is applied to the second speaker SP2, for example.

More specifically, the phase characteristic of the speaker apparatus in the embodiment, is set on the basis of the following four types of conditions. The first condition is to reduce the sound pressure level of the emitted sound waves only in any one of the lateral direction (or horizontal direction), i.e. in either the right direction or the left direction. The second condition is to bring a phase difference in the lateral direction close to "180 (degrees)" (i.e. opposite phase). The third condition is to hardly cause or not to cause the phase difference at all in the front direction, in other words, to keep the disorder or noise or loss of the sound pressure level in the front direction within a predetermined allowable range ("about 3(dB)"). The fourth condition is to minimize the disorder or noise or loss of the sound pressure level in the front direction in the third condition while satisfying the second condition. Incidentally, the phase changing device of the present invention may be achieved by a digital filter circuit. As a result, the desired phase characteristic can be achieved, with the approximation accuracy increased, on the basis of the digital filter circuit.

(2) Phase Characteristic

Next, with reference to FIG. 4 to FIG. 7, an explanation will be given on the phase characteristic which indicates the amount of phase change determined with the frequency as a parameter, in the embodiment. FIG. 4 is a graph showing one specific example of the phase characteristic which indicates the amount of phase change determined with the frequency as a parameter, in the embodiment. FIG. 5 are a graph showing one specific example of the phase characteristic in the embodiment (FIG. 5(*a*)), and a schematic diagram schematically showing a basic principle when a phase is changed by 180 degrees, in the phase characteristic in the embodiment (FIG. 5(*b*)). FIG. 6 are a graph showing one specific example of the phase characteristic in the embodiment (FIG. 6(*a*)), and a schematic diagram schematically showing the basic principle when the phase is changed by 90 degrees, in the phase characteristic in the embodiment (FIG. 6(*b*)). FIG. 7 are a graph showing one specific example of the phase characteristic in the embodiment (FIG. 7(*a*)), and a schematic diagram schematically showing the basic principle when the phase is not changed, in the phase characteristic in the embodiment (FIG. 7(*b*)).

As shown in FIG. 4, in the phase characteristic in the embodiment, a non-linear curve which indicates the amount of phase change with the frequency as the parameter, is defined such that the amount of phase change takes a value of 0 degree at least at a reference frequency (e.g. 1.75 (kHz)). Here, the reference frequency in the embodiment can be defined on the basis of the speed of sound in the air, and means a frequency corresponding to a wavelength about twice as long as the predetermined distance. In the non-linear curve which indicates the phase characteristic in the embodiment, as the frequency approaches the reference frequency, the amount of phase change reduces. Moreover, as the frequency departs from the reference frequency, the amount of phase change increases. Incidentally, a dashed line in FIG. 4 indicates a change on the graph (i.e. a range of the vertical axis: ±180 degrees) which results from satisfying the second condition that the phase difference in the lateral direction is brought close to "180 (degrees)" (i.e. opposite phase), by a simulation, an experimental equation, theoretical equation, or experiential equation.

Specifically, as shown in FIG. 5(*a*), the frequency of the audio signal is, for example, a frequency of about 200 (Hz) (refer to a point "P1") and a wavelength corresponding to the frequency of the audio signal is significantly greater than the predetermined distance, then the phase of the audio signal reproduced on at least one of the first speaker and the second speaker, is changed, such as advanced or delayed, by about 180 degrees, for example.

In other words, as shown in FIG. 5(*b*), if the wavelength of a first sound wave (refer to a "sound 1") emitted from the first speaker, which corresponds to the frequency of the audio signal, and the wavelength of a second sound wave (refer to a "sound 2") emitted from the second speaker, which corresponds to the frequency of the audio signal, are several to several hundred times longer than the predetermined distance "L" between the first speaker SP1 and the second speaker SP2, the phase of the audio signal reproduced on at least one of the first speaker and the second speaker, is changed, such as advanced or delayed, by about 180 degrees (i.e. π), for example. Therefore, there is a phase difference of about 180 degrees (i.e. π), for example, between the phase of the first sound wave emitted from the first speaker and the phase of the second sound wave emitted from the second speaker, in any one of the lateral direction (or horizontal direction), i.e. in either the right direction or the left direction.

Alternatively, as shown in FIG. 6(*a*), if the frequency of the audio signal is a reference frequency of about 900 (Hz) or the like (refer to a point "P2"), for example, the phase of the audio signal reproduced on at least one of the first speaker and the second speaker, is changed, such as advanced or delayed, by about 90 degrees (i.e. π/2), for example.

In other words, as shown in FIG. 6(*b*), if the predetermined distance "L" between the first speaker SP1 and the second speaker SP2 is about ¼ of the wavelength of the first sound wave (refer to the "sound 1") emitted from the first speaker, which corresponds to the frequency of the audio signal, and the wavelength of the second sound wave (refer to the "sound 2") emitted from the second speaker, which corresponds to the frequency of the audio signal, then the phase of the audio signal reproduced on at least one of the first speaker and the second speaker is changed, such as advanced or delayed, by about 90 degrees (i.e. $\pi/2$), for example, i.e. is not changed. Therefore, there is a phase difference of about 180 degrees (i.e. $\pi$), for example, between the phase of the first sound wave emitted from the first speaker and the phase of the second sound wave emitted from the second speaker, in any one of the lateral direction (or horizontal direction), i.e. in either the right direction or the left direction.

Alternatively, as shown in FIG. 7(*a*), if the frequency of the audio signal is a reference frequency of about 1750 (Hz) or the like (refer to a point "P3"), for example, the phase of the audio signal reproduced on at least one of the first speaker and the second speaker, is changed, such as advanced or delayed, by about 0 degree, for example, i.e. is not changed.

In other words, as shown in FIG. 7(*b*), if the predetermined distance "L" between the first speaker SP1 and the second speaker SP2 is about ½ of the wavelength of the first sound wave (refer to the "sound 1") emitted from the first speaker, which corresponds to the frequency of the audio signal, and the wavelength of the second sound wave (refer to the "sound 2") emitted from the second speaker, which corresponds to the frequency of the audio signal, then the phase of the audio signal reproduced on at least one of the first speaker and the second speaker is changed, such as advanced or delayed, by about 0 degree, for example, i.e. is not changed. Therefore, there is a phase difference of about 180 degrees (i.e. $\pi$), for example, between the phase of the first sound wave emitted from the first speaker and the phase of the second sound wave emitted from the second speaker, in any one of the lateral direction (or horizontal direction), i.e. in either the right direction or the left direction.

As a result, for example, in any one of the lateral direction (or horizontal direction), i.e. in either the right direction or the left direction, the first sound wave emitted from the first speaker and the second sound wave emitted from the second speaker, are canceled on the basis of the phase difference of about 180 degrees (i.e. $\pi$), for example, and the sound pressure level corresponding to the frequency of the audio signal can be set to almost zero.

On the other hand, in the front direction, the sound pressure level of the combined sound wave of the first sound wave and the second sound wave is maintained (only on the basis of the phase difference of the audio signals), at a normal level in which there is little influence or no influence of the interference of the sound waves. Moreover, in the other direction of the right direction and the left direction, the sound pressure level of either the first sound wave or the second sound wave, is maintained at the normal level in which there is little influence or no influence of the interference of the sound waves.

As a result, according to the speaker apparatus SP in the embodiment, the sound pressure level of the emitted sound waves, is relatively reduced in any one of the lateral direction (or horizontal direction), i.e. in either the right direction or the left direction. At the same time, the sound pressure level is relatively increased (i) in the front direction and (ii) in either the right direction or the left direction). Therefore, it is possible to make the sound waves emitted from the first speaker and the second speaker, properly maintain the directionality.

(3) Study of Operation and Effect in the Embodiment

Next, with reference to FIG. 8 to FIG. 10, the operation and effect in the embodiment will be studied. FIG. 8 is a graph showing another specific example of the phase characteristic which indicates the amount of phase change determined with the frequency as the parameter, in the embodiment. FIG. 9 are a graph showing a relationship among an angle in a directional direction in which a sound is emitted, a frequency, and a sound pressure level in the embodiment (FIG. 9(*a*)), and a graph showing a relationship between the sound pressure level and the frequency in the embodiment (FIG. 9(*b*)). FIG. 10 are a graph showing a relationship between the angle in the directional direction in which the sound is emitted, and the frequency in a comparison example (FIG. 10(*a*)), and a graph showing a relationship between the sound pressure level and the frequency in the comparison example (FIG. 10(*b*)). Incidentally, in FIG. 9 and FIG. 10, "+(i.e. plus)" (or "− (i.e. minus)") is defined on the basis of either the right direction or the left direction, which is based on the perpendicular direction to the horizontal direction in which the first speaker and the second speaker are arranged.

As shown in FIG. 8, the phase characteristic of the phase changing device in the embodiment, is defined. A dashed line in FIG. 8, indicates a targeted theoretical phase characteristic. Incidentally, the targeted theoretical phase characteristic is defined such that the disorder or the noise of the sound pressure level is within 3 (dB) in a direction, i.e. in the front direction, which is 90 degrees different from the horizontal direction in which the first speaker SP1 and the second speaker SP2 are horizontally disposed. On the other hand, a solid line in FIG. 8 indicates the phase characteristic actually achieved. Incidentally the phase characteristic actually achieved is set such that the predetermined distance "L" between the first speaker SP1 and the second speaker SP2 is "10 (cm)", that the reference angular frequency of the first-order filter circuit "APF1", which is one specific example of the phase changing device of the present invention, is 280 (Hz), and that the reference angular frequency of the second-order filter circuit "APF2", which is another specific example of the phase changing device of the present invention, is 1850 (Hz). Moreover, the diameters of the sound emitting parts of the first speaker SP1 and the second speaker SP2 are both set to "5 (cm)".

On the basis of the phase characteristic set in this manner, as shown in FIG. 9(*a*), in a first audio signal with a frequency of 1 (kHz) to 2 (kHz), when the angle in the directional direction in which the sound is emitted, is "−90 (degrees)" to "−60 (degrees)", the sound pressure level is "−20" to "−18", and the sound pressure level can be reduced. In addition, as shown in the solid line and the dashed line in FIG. 9(*b*), if the sound pressure level in the front direction, such as "+30 (degrees)" to "−30 (degrees)" is compared with the sound pressure level in the lateral direction, such as "−60 (degrees)" to "−90 (degrees)", it is possible to confirm that the sound pressure level in the lateral direction, is extremely reduced in a range that the frequency of the audio signal corresponds to a human voice, such as "800 (Hz)" to "3 (KHz)". It will be obvious that the first audio signal and a second audio signal are combined, in the sound pressure level in the front direction.

Incidentally, with regard to the fact that the sound pressure level in the lateral direction increases near a frequency of "5

(kHz)", since it is included in a frequency band in which a sound absorbent described later operates effectively, the increased sound pressure level can be attenuated by the sound absorbent.

In a comparison example in which the aforementioned phase characteristic is not considered, as shown in FIG. 10(*a*), the relative reduction in the sound pressure level can be achieved only for the audio signal in an extremely narrow frequency band, and it is hard to achieve the directionality for the audio signal in a relatively wide frequency band. Incidentally, as shown in a solid line and a dashed line in FIG. 10, for example, if the sound pressure level in the front direction, such as "+30 (degrees)" to "−30 (degrees)"is compared with the sound pressure level in the lateral direction, such as "−60 (degrees)" to "−90 (degrees)", it can be seen that the sound pressure level in the lateral direction is greater than the sound pressure level shown in FIG. 9(*a*) in the embodiment in a range that the frequency of the audio signal corresponds to a human voice, such as "800 (Hz)" to "2 (KHz)".

In contrast, according to the embodiment, on the basis of the aforementioned phase characteristic, as shown in FIG. 9(*a*), in the first audio signal with a frequency of 1 (kHz) to 2 (kHz), when the angle in the directional direction in which the sound is emitted, is "−90 (degrees)" to "−60 (degrees)", the sound pressure level is "−20" to "−18", and the sound pressure level can be reduced.

As a result, for example, it is possible to relatively reduce the sound pressure level of the sound waves emitted from the first speaker and the second speaker in any one of the lateral direction, i.e. in either the right direction or the left direction. Moreover, it is also possible to make the emitted sound waves properly maintain the directionality. In addition, it is possible to simply achieve the small-sized phase changing device at low cost, on the basis of the analog all-pass filter circuit, such as the first-order filter circuit and the second-order filter circuit, which is designed, with the physical condition and the physical property clarified.

(4) Other Embodiments

Next, with reference to FIG. 11 to FIG. 17, other embodiments will be explained.

(4-1) Another Embodiment (Ver. 1)

Firstly, with reference to FIG. 11 to FIG. 13, another embodiment (ver. 1) will be explained. FIG. 11 are block diagrams schematically showing one and another basic structures of a speaker apparatus in another embodiment (ver. 1) (FIG. 11(*a*) and FIG. 11(*b*)). FIG. 12 is a graph schematically showing the phase characteristic combined on the filter circuits provided for the speaker apparatus in another embodiment (ver. 1). FIG. 13 is a block diagram schematically showing another basic structure of the speaker apparatus in another embodiment (ver. 1).

As shown in FIG. 11(*a*), in order to achieve the aforementioned phase characteristic, in one or one kind of basic structure of the speaker apparatus in another embodiment, it may be provided with: the first speaker SP1; the second speaker SP2; the first-order filter circuit APF1 connected to the first speaker SP1; and a dual second-order filter circuit APF2*a* which is connected to the first speaker SP1 and which keeps a dual relationship with the second-order filter circuit APF2. Here, with regard to the "dual relationship"in the embodiment, specifically, the filter circuit which has the dual relationship with the first-order filter circuit is a filter circuit having such a structure that the inductor and the capacitor are replaced. The filter circuit which has the dual relationship with the second-order filter circuit is a filter circuit having such a structure that a serial resonance circuit and a parallel resonance circuit are replaced.

More specifically, if the first-order filter circuit APF1 and the dual second-order filter circuit APF2*a* are connected together to the first speaker SP1, as shown in FIG. 12, a amplitude characteristic may be constant amplitude characteristic (e.g. 0(dB)), and such a physical property may be provided (i) that the amount of phase change is "−90 (degrees)" at a reference angular frequency "ωn1" and (ii) that the amount of phase change is "−180 (degrees)" if the angular frequency exceeds a reference angular frequency "ωn2".

Alternatively, as shown in FIG. 11(*b*), in order to achieve the aforementioned phase characteristic, in another basic structure of the speaker apparatus in another embodiment, it may be provided with: the first speaker SP1; the second speaker SP2; the first-order filter circuit APF1 connected to the first speaker SP1; the second-order filter circuit APF2 connected to the second speaker SP2; and a dual first-order filter circuit APF1*a* which keeps a dual relationship with the first-order filter circuit APF1.

Moreover, alternatively, as shown in FIG. 13, in order to achieve the aforementioned phase characteristic, in another basic structure of the speaker apparatus in another embodiment, it may be provided with: the first speaker SP1; the second speaker SP2; the first-order filter circuit APF1 connected to the first speaker SP1; and the first-order filter circuit APF1 connected to the second speaker SP2.

As a result, it is possible to reduce the number of parts to achieve the aforementioned phase characteristic.

(4-2) Another Embodiment (Ver. 2)

Next, with reference to FIG. 14, another embodiment (ver. 2) will be explained. FIG. 14 is a block diagram schematically showing another basic structure of a speaker apparatus in another embodiment (ver. 2).

As shown in FIG. 14, in another basic structure of the speaker apparatus in another embodiment, it may be provided with: the first speaker SP1; the second speaker SP2; the first-order filter circuit APF1 connected to the first speaker SP1; the second-order filter circuit APF2 connected to the second speaker SP2; a sound absorbent 1; and a sound absorbent 2. In particular, the sound absorbent 1 and the sound absorbent 2 are arranged in the lateral direction (or horizontal direction).

As a result, the sound pressure level of the sound waves emitted from the first speaker SP1 and the second speaker SP2 is relatively reduced in any one of the lateral direction (or horizontal direction), i.e. in either the right direction or the left direction. At the same time, the sound pressure level is relatively increased (i) in the front direction and (ii) in either the right direction or the left direction. Therefore, it is possible to make the sound waves emitted from the first speaker SP1 and the second speaker SP2, properly maintain the directionality.

(4-3) Another Embodiment (Ver. 3)

Next, with reference to FIG. 15, another embodiment (ver. 3) will be explained. FIG. 15 is a block diagram schematically showing another basic structure of a speaker apparatus in another embodiment (ver. 3).

As shown in FIG. 15, in another basic structure of the speaker apparatus in another embodiment, it may be provided with: the first speaker SP1; the second speaker SP2; the first-order filter circuit APF1 connected to the first speaker SP1;

and the second-order filter circuit APF2 connected to the second speaker SP2. In particular, the second speaker SP2 is disposed such that the reproduction direction of the second speaker SP2 crosses the reproduction direction of the first speaker SP1 at 90 degrees, for example. Incidentally, the gain of the sound pressure level may be further adjusted.

As a result, on the basis of the different reproduction directions of the first speaker SP1 and the second speaker SP2, it is possible to make the sound waves emitted from the first speaker SP1 and the second speaker SP2, properly maintain the directionality.

(4-4) Another Embodiment (Ver. 4)

Next, with reference to FIG. 16 and FIG. 17, another embodiment (ver. 4) will be explained. FIG. 16 is a block diagram schematically showing another basic structure of a speaker apparatus in another embodiment (ver. 4). FIG. 17 is a schematic diagram schematically showing an application example of the speaker apparatus in another embodiment (ver. 4).

As shown in FIG. 16, in another basic structure of the speaker apparatus in another embodiment, it may be provided with: the first speaker SP1 for reproducing the first sound signal which maintains music; the second speaker SP2 for reproducing the second audio signal which maintains a line (or words); the first-order filter circuit APF1 connected to the first speaker SP1; the second-order filter circuit APF2 connected to the second speaker SP2; a first-order filter circuit APF1*x* connected to the second speaker SP2; and a second-order filter circuit APF2*x* connected to the first speaker SP1.

Therefore, for example, in any one (e.g. the second speaker side) of the lateral direction, i.e. in either the right direction or the left direction, the first sound wave emitted from the first speaker (i.e. the first sound wave corresponding to the music) and the second sound wave emitted from the second speaker (i.e. the second sound wave corresponding to the music) are canceled on the basis of the phase difference of about 180 degrees (i.e. $\pi$), for example, and the sound pressure level corresponding to the frequency of the audio signal can be set to almost zero. On the other hand, in the front direction, the sound pressure level of the combined sound wave of the first sound wave (i.e. the first sound wave corresponding to the music) and the second sound wave (i.e. the second sound wave corresponding to the music) is maintained (only on the basis of the phase difference of the audio signals), at a normal level in which there is little influence or no influence of the interference of the sound waves. Moreover, in the other direction (e.g. the first speaker side) of the right direction and the left direction, the sound pressure level of the first sound wave (i.e. the first sound wave corresponding to the music) is maintained at the normal level in which there is little influence or no influence of the interference of the sound waves.

As a result, according to the speaker apparatus SP in the embodiment, the sound pressure level of the emitted sound waves (i.e. the first sound wave and the second sound wave corresponding to the music) is relatively reduced in any one of the lateral direction (or horizontal direction), i.e. in either the right direction or the left direction. At the same time, the sound pressure level is relatively increased (i) in the front direction and (ii) in either the right direction or the left direction. Therefore, it is possible to make the sound waves emitted from the first speaker and the second speaker (i.e. the first sound wave and the second sound wave corresponding to the music), properly maintain the directionality.

Substantially in the same manner, for example, in any one (e.g. the first speaker side) of the lateral direction, i.e. in either the right direction or the left direction, the first sound wave emitted from the first speaker (i.e. the first sound wave corresponding to the line) and the second sound wave emitted from the second speaker (i.e. the second sound wave corresponding to the line) are canceled on the basis of the phase difference of about 180 degrees (i.e. $\pi$), for example, and the sound pressure level corresponding to the frequency can be set to almost zero. On the other hand, in the front direction, the sound pressure level of the combined sound wave of the first sound wave (i.e. the first sound wave corresponding to the line) and the second sound wave (i.e. the second sound wave corresponding to the line) is maintained (only on the basis of the phase difference of the audio signals), at a normal level in which there is little influence or no influence of the interference of the sound waves. Moreover, in the other direction (e.g. the second speaker side) of the right direction and the left direction, the sound pressure level of the second sound wave (i.e. the second sound wave corresponding to the line) is maintained at the normal level in which there is little influence or no influence of the interference of the sound waves.

As a result, the sound pressure level of the sound waves emitted from the first speaker and the second speaker (i.e. the first sound wave and the second sound wave corresponding to the line) is relatively reduced in any one of the lateral direction (or horizontal direction), i.e. in either the right direction or the left direction. At the same time, the sound pressure level is relatively increased (i) in the front direction and (ii) in either the right direction or the left direction. Therefore, it is possible to make the sound waves emitted from the first speaker and the second speaker (i.e. the first sound wave and the second sound wave corresponding to the line), properly maintain the directionality.

More specifically, as shown in FIG. 17, in an occupant space of a car, the audio signal which maintains the line, such as weather information, can be reproduced in the front seat side, and simultaneously, the audio signal which maintains a movie sound can be also reduced in the backseat side.

Consequently, it is possible to make the sound waves which correspond to a plurality of audio signals and which are emitted from the first speaker SP1 and the second speaker SP2 for reproducing the different plurality of audio signals, properly maintain the directionality.

In the aforementioned embodiments, the household or on-vehicle speaker apparatus is explained; however, the present invention can be also applied to a speaker apparatus in a large space, such as a store and a concert hall for business use.

Incidentally, the present invention is not limited to the aforementioned embodiments, but may be changed, if necessary, without departing from the scope or idea of the invention, which can be read from all the claims and the specification thereof. The speaker apparatus with such a change is also included in the technical scope of the present invention.

INDUSTRIAL APPLICABILITY

The speaker apparatus of the present invention can be applied to a speaker apparatus provided with at least two speakers having directionality in the reproduction direction of an audio signal, for example.

The invention claimed is:

1. A speaker apparatus comprising:

a first speaker which reproduces an audio signal; and a second speaker which reproduces the audio signal and which is disposed and separated from said first speaker by a predetermined distance in a horizontal direction, at least one of said first speaker and said second speaker having a phase changing device for changing a phase of the audio signal by a predetermined amount of phase on the basis of (i) a frequency of the audio signal and (ii) the predetermined distance, the phase changing device (i) reducing the predetermined amount as the frequency of the audio signal approaches a reference frequency corresponding to a wavelength almost twice as long as the predetermined distance and (ii) increasing the predetermined amount as the frequency of the audio signal departs from the reference frequency.

2. The speaker apparatus according to claim 1, wherein the phase changing device sets the predetermined amount to be almost zero if the frequency of the audio signal is substantially equal to a reference frequency corresponding to a wavelength almost twice as long as the predetermined distance.

3. The speaker apparatus according to claim 1, wherein the phase changing device sets a reference frequency corresponding to a wavelength almost twice as long as the predetermined distance, in a predetermined range corresponding to a human voice.

4. The speaker apparatus according to claim 1, wherein the phase changing device performs the changing by the predetermined amount of phase, on the basis of a sound pressure level of a combined sound wave obtained by combining a first sound wave emitted from said first speaker and a second sound wave emitted from said second speaker.

5. The speaker apparatus according to claim 1, wherein the phase changing device is a filter circuit including an inductor or a capacitor.

6. The speaker apparatus according to claim 1, wherein the phase changing device is an all-pass filter circuit including an inductor or a capacitor.

7. The speaker apparatus according to claim 1, wherein the phase changing device includes at least one of (i) a first-order filter circuit for changing the audio signal by a phase of a first angle and (ii) a second-order filter circuit for changing the audio signal by a phase of a second angle.

8. The speaker apparatus according to claim 7, wherein the phase changing device includes (i) a dual second-order filter circuit which maintains a dual relationship with the second-order filter circuit, in addition to or instead of the first-order filter circuit, or (ii) a dual first-order filter circuit which maintains a dual relationship with the first-order filter circuit, in addition to or instead of the second-order filter circuit.

9. The speaker apparatus according to claim 1, wherein at least one of said first speaker and said second speaker has one phase changing device corresponding to one audio signal, and at least the other of said first speaker and said second speaker has another phase changing device corresponding to another audio signal.

10. The speaker apparatus according to claim 1, wherein the phase changing device is a digital filter circuit.

11. The speaker apparatus according to claim 1, wherein said first speaker and said second speaker have substantially the same reproduction direction and are aligned in the horizontal direction, and said speaker apparatus further comprises a sound absorbent near an outer side of said first speaker and said second speaker.

12. The speaker apparatus according to claim 1, wherein a reproduction direction of said first speaker and a reproduction direction of said second speaker are different by about 90 degrees.

13. The speaker apparatus according to claim 1, wherein the phase changing device (i) reduces an absolute value of the predetermined amount as the frequency of the audio signal approaches a reference frequency corresponding to a wavelength almost twice as long as the predetermined distance and (ii) increases the absolute value of the predetermined amount as the frequency of the audio signal departs from the reference frequency.

* * * * *